US010371444B2

(12) United States Patent
Nakata et al.

(10) Patent No.: US 10,371,444 B2
(45) **Date of Patent: *Aug. 6, 2019**

(54) DRYING METHOD FOR TEREPHTHALIC ACID AND HORIZONTAL ROTARY DRYER

(71) Applicant: TSUKISHIMA KIKAI CO., LTD., Tokyo (JP)

(72) Inventors: Yoichi Nakata, Tokyo (JP); Yuichi Ono, Tokyo (JP); Satoshi Suwa, Tokyo (JP); Sumito Sato, Tokyo (JP)

(73) Assignee: TSUKISHIMA KIKAI CO., LTD., Tokyo (JP)

( * ) Notice: Subject to any disclaimer, the term of this patent is extended or adjusted under 35 U.S.C. 154(b) by 391 days.

This patent is subject to a terminal disclaimer.

(21) Appl. No.: 15/123,561

(22) PCT Filed: Dec. 9, 2015

(86) PCT No.: PCT/JP2015/084517

§ 371 (c)(1),
(2) Date: Sep. 2, 2016

(87) PCT Pub. No.: WO2017/046970

PCT Pub. Date: Mar. 23, 2017

(65) Prior Publication Data

US 2018/0187974 A1 Jul. 5, 2018

(30) Foreign Application Priority Data

Sep. 15, 2015 (JP) ..... 2015-182326

(51) Int. Cl.
*F26B 3/24* (2006.01)
*F26B 17/32* (2006.01)
*F26B 23/10* (2006.01)

(52) U.S. Cl.
CPC ..... *F26B 17/32* (2013.01); *F26B 3/24* (2013.01); *F26B 23/10* (2013.01)

(58) Field of Classification Search
CPC ..... F26B 17/32; F26B 3/02; C10L 15/04
(Continued)

(56) References Cited

U.S. PATENT DOCUMENTS 1,332,137 A * 2/1920 Newhouse ..... F26B 11/028 34/109
1,554,239 A * 9/1925 Sprague ..... F26B 17/003 110/225

(Continued)

FOREIGN PATENT DOCUMENTS

EP 3168560 A1 * 5/2017 ..... F26B 17/32
EP 3168560 A4 * 8/2017 ..... F26B 17/32

(Continued)

*Primary Examiner* — Stephen M Gravini
(74) *Attorney, Agent, or Firm* — Muncy, Geissler, Olds & Lowe, P.C.

(57) ABSTRACT

To provide a drying method for terephthalic acid and a horizontal rotary dryer allowing easy performance of mass processing of the terephthalic acid and enabling size reduction by improving drying performance of the dryer. In a method of drying terephthalic acid by using a horizontal rotary dryer, a rotating shell is rotated to make a critical speed ratio α defined by expression 1 and expression 2 become 17 to less than 80% to dry the processing material, $$Vc=2.21D^{1/2} \quad \text{Expression 1}$$

$$\alpha=V/Vc\cdot 100 \quad \text{Expression 2}$$

wherein Vc indicates a critical speed (m/s) of the rotating shell, D indicates an inside diameter (m) of the rotating shell, α indicates the critical speed ratio (%) of the rotating shell, and V indicates a rotation speed (m/s) of the rotating shell.

6 Claims, 27 Drawing Sheets

(58) Field of Classification Search
USPC ..... 34/499, 173
See application file for complete search history.

(56) References Cited

U.S. PATENT DOCUMENTS 2,030,734 A * 2/1936 Baird ..... F26B 17/003 159/11.3
3,674,449 A * 7/1972 Schmalfeld et al. ..... C10L 5/22 44/591
4,337,583 A * 7/1982 Harris ..... B01F 7/00558 34/180
4,535,550 A 8/1985 Walter
4,864,942 A * 9/1989 Fochtman ..... B09B 3/0091 110/226
5,271,163 A * 12/1993 Pikus ..... F26B 17/20 34/181
5,566,469 A * 10/1996 Bolton ..... F26B 11/0463 34/135
5,746,006 A * 5/1998 Duske ..... F26B 11/0477 34/136
5,791,066 A * 8/1998 Crews ..... B04C 5/08 34/168
6,185,842 B1 * 2/2001 Brashears ..... E01C 19/1063 34/137
7,380,348 B2 * 6/2008 Seebach ..... B04C 3/00 34/326
8,726,532 B2 * 5/2014 Hogan ..... F26B 17/103 15/345
8,793,897 B2 * 8/2014 Brosig ..... C04B 11/007 106/772
9,429,362 B2 * 8/2016 Kanai ..... F26B 17/22
9,671,166 B2 * 6/2017 Plavnik ..... F26B 7/00
9,683,779 B2 * 6/2017 Kataoka ..... F26B 11/0409
2013/0174436 A1 * 7/2013 Kataoka ..... F26B 11/0409 34/109
2015/0247101 A1 * 9/2015 Sudo ..... C10L 5/04 44/530
2016/0145520 A1 * 5/2016 Koulik ..... B01J 19/088 44/606
2016/0355744 A1 * 12/2016 Nakagawa ..... C10L 9/06
2017/0089640 A1 * 3/2017 Nakata ..... F26B 17/32
2017/0145642 A1 * 5/2017 Swanson ..... F26B 17/32
2017/0248365 A1 * 8/2017 Kataoka ..... F26B 11/0409
2018/0187974 A1 * 7/2018 Nakata ..... F26B 17/32

FOREIGN PATENT DOCUMENTS

JP 58-501245 A 7/1983
JP 62-60632 A 3/1987
JP H0519895 3/1993
JP 2515070 Y2 10/1996
JP 2002022363 A 1/2002
JP 200269458 A 3/2002
JP 2006022986 A 1/2006
JP 200864386 A 3/2008
JP 2008275236 A 11/2008
JP 2009-203163 A 9/2009
JP 2010-236846 A 10/2010
JP 2010236846 A 10/2010
JP 2014-55687 A 3/2014
JP 5746391 B1 5/2015
JP 5778831 B1 9/2015
JP 2015200483 A 11/2015
WO WO-2017046970 A1 * 3/2017 ..... F26B 17/32

* cited by examiner

FIG. 27

| | DRY | PENDULAR REGION | FUNICULAR REGION 1 | FUNICULAR REGION 2 | CAPILLARY REGION | SLURRY |
|---|---|---|---|---|---|---|
| SOLID PHASE | CONTINUOUS | CONTINUOUS | CONTINUOUS | CONTINUOUS | DISCONTINUOUS | DISCONTINUOUS |
| LIQUID PHASE | 0 | DISCONTINUOUS | CONTINUOUS | CONTINUOUS | CONTINUOUS | CONTINUOUS |
| GAS PHASE | CONTINUOUS | CONTINUOUS | CONTINUOUS | DISCONTINUOUS | 0 | 0 |
| STATE | VERY DRIED | DRIED | | STICKY | | MUSHY |

DRYING METHOD FOR TEREPHTHALIC ACID AND HORIZONTAL ROTARY DRYER

TECHNICAL FIELD

The present invention relates to a drying method for terephthalic acid and a horizontal rotary dryer improving a drying rate.

BACKGROUND ART

As a dryer which dries processing materials such as coals or ores, a steam tube dryer (which is referred to as "STD", hereinafter), a coal-in-tube (Patent Document 1), a rotary kiln, and the like are often used. The aforementioned coals or ores are used as raw materials for iron making or refining, fuel for power generation, and the like, and since it is demanded to process a mass of the coals or ores in a stable manner, the above-described respective dryers have been employed as dryers which fulfill the demand.

The STD indirectly heats the processing materials, so that a thermal efficiency is high, and a processing amount per unit volume is also large. Further, it is also possible to increase a size of the STD, so that the STD fulfills the demand regarding mass processing.

The coal-in-tube also indirectly heats the processing materials, so that a thermal efficiency is high, and a processing amount per unit volume is also large, in a similar manner to the aforementioned STD. However, the coal-in-tube has a disadvantageous point that a size thereof is difficult to be increased, when compared to the STD. For example, when an amount capable of being processed by one STD described above is tried to be processed by the coal-in-tube, a plurality of the coal-in-tubes are sometimes required.

The rotary kiln applies hot air to the processing materials to directly dry the processing materials, and thus it has a disadvantageous point that a heat efficiency is lower than that provided by the indirect heating. Further, there is also a disadvantageous point that an exhaust gas processing facility becomes very large. From the reasons as described above, the STD has precedence as the dryer which processes a mass of processing materials.

PRIOR ART DOCUMENT

Patent Document

Patent Document 1: Publication of Utility Model Registration No. 2515070

Patent Document 2: Japanese Examined Patent Application Publication No. Sho 62-60632

DISCLOSURE OF THE INVENTION

Problems to Be Solved By the Invention

In recent years, the demand regarding the drying processing of mass of the processing materials is strong, and in order to meet the demand, a size of the dryer is becoming larger. When the increase in size of the STD is cited as an example, the STD whose shell diameter is 4 m and whose main body length is 30 m or longer is manufactured.

However, the increase in size of the dryer creates not only a problem such that an installation area has to be increased, but also problems in terms of manufacture and transportation. Concretely, a plate thickness of each member is increased to maintain strength, and weight of the main body of the aforementioned STD whose shell diameter is 4 m and whose main body length is 30 m, reaches 400 tons. Accordingly, there is a problem that it takes a lot of time until when the manufacture is completed. Further, there is also a problem that a special facility is required for the manufacture.

Further, in accordance with the increase in size, when a product is transported, a special vehicle capable of supporting weight of the product becomes required, and when a transportation route is narrow, the product has to be divided to be transported, and joined and assembled at a job site, and thus the construction work is very complicated, which is also a problem.

These problems arise also in drying processing in which a processing material is terephthalic acid.

The present inventor found out a task that, based on the fact that there is a limitation in the increase in size of the apparatus described above, the aim should be to improve a drying rate of a drying target (processing material), specifically, terephthalic acid.

Therefore, the task of the present invention is to improve a drying rate of terephthalic acid dried by a dryer.

Further, the task of the present invention is to avoid the above-described problems in accordance with the increase in size of the apparatus to the utmost, by the present invention capable of increasing a drying processing amount per size (shell diameter) of the dryer.

Means for Solving the Problems

The present invention solving the above-described problems is as follows.

<Invention Described in claim 1>

A drying method for terephthalic acid using a horizontal rotary dryer provided with: a rotating shell having a feed port for terephthalic acid on one end side thereof and a discharge port for terephthalic acid on the other end side thereof, and capable of freely rotating around an axial center; and a group of heating tubes through which a heating medium passes, provided within the rotating shell, and configured in a manner that the terephthalic acid is lifted up in a rotational direction by the group of heating tubes in accordance with the rotation of the rotating shell, the drying method for terephthalic acid including drying, through indirect heating, the terephthalic acid by using the group of heating tubes in a process of feeding the terephthalic acid to the one end side of the rotating shell and discharging the terephthalic acid from the other end side of the rotating shell, in which the rotating shell is rotated to make a critical speed ratio α defined by the following expression 1 and expression 2 become 17 to less than 80% to dry the terephthalic acid, $$Vc=2.21D^{1/2} \quad \text{Expression 1}$$

$$\alpha=V/Vc\cdot 100 \quad \text{Expression 2}$$

wherein Vc indicates a critical speed (m/s) of the rotating shell, D indicates an inside diameter (m) of the rotating shell, α indicates the critical speed ratio (%) of the rotating shell, and V indicates a rotation speed (m/s) of the rotating shell.

(Operation and Effect)

Conventionally, when an inside diameter of a rotating shell of a heating apparatus for terephthalic acid is 3.8 m, operation has been conducted by setting a number of rotations of the rotating shell to 2.5 to 3.5 rpm. This heating apparatus generates, with the use of the rotation of the rotating shell, propulsive force which conveys the terephthalic acid to the outlet, in the heating apparatus. At this time, if the number of rotations is low in spite of a large conveyance amount of the terephthalic acid, the terephthalic acid is sometimes accumulated too much to clog a flow path in the heating apparatus. In order to avoid such a trouble, in view of flowability of the terephthalic acid, the operation is performed by adjusting the number of rotations based on empirical rule in a manner that the number of rotations is increased when the conveyance amount of the terephthalic acid is large, and the number of rotations is set to be low when the conveyance amount of the terephthalic acid is small.

On the other hand, according to the findings of the present inventors, there is a problem that when a size of the STD (the inside diameter of the rotating shell) is changed, even if the STD is rotated with the same number of rotations, a drying rate of the terephthalic acid changes, and it is difficult to predict the rate. Particularly, as the STD becomes large, it becomes further difficult to predict the drying rate, so that a heat transfer area has been designed to be a large area, to thereby give a margin to drying performance.

Due to such reasons, it has been difficult, in the conventional example, to bring out desired drying performance when a scale-up is performed from a test machine to an actual machine. On the contrary, by using the drying method for terephthalic acid according to the present invention to decide the rotation speed of the rotating shell, it becomes easy to bring out the desired drying performance when the scale-up is conducted.

Further, in the drying method for terephthalic acid of the present invention, by increasing the rotation speed of the dryer, the drying performance can be dramatically improved when compared to the conventional drying performance, and thus it becomes possible to perform mass processing of terephthalic acid.

<Invention Described in claim 2>

In the drying method for terephthalic acid described in claim 1, a liquid content of the terephthalic acid fed to the horizontal rotary dryer is 3 to 19 wt % W.B.

(Operation and Effect)

When the terephthalic acid whose liquid content is 3 to 19 wt % W.B. is fed to the dryer, by rotating the rotating shell by selecting the rotation speed of the rotating shell so that the critical speed ratio $\alpha$ of the rotating shell becomes 17 to less than 80%, the drying rate of the terephthalic acid can be increased, when compared to the conventional drying rate.

Generally, when the liquid content of the terephthalic acid exceeds 19 wt % W.B., the terephthalic acid turns into one in a mushy mucous state. For this reason, when the terephthalic acid whose liquid content exceeds 19% is fed to the dryer, the terephthalic acid adheres to an inside wall of the rotating shell, and the rotating shell and the terephthalic acid rotate together. Since the terephthalic acid hardly falls in a space within the rotating shell from an upper direction to a lower direction of the rotating shell, a contact area between the terephthalic acid and the group of heating tubes is not increased, resulting in that the drying rate cannot be increased.

Meanwhile, in order to set the liquid content of the terephthalic acid to less than 3 wt % W.B., there is a need to perform, in a dehydration process before a dying process, dehydration with application of high load by using a highly-functional and expensive hydro-extractor, which is not favorable from a viewpoint of economic efficiency, power-saving, and the like.

<Invention Described in claim 3>

In the drying method for terephthalic acid described in claim 1, the terephthalic acid is fed into the rotating shell to make a hold up ratio $\eta$ of the terephthalic acid defined by the following expression 3 become 20 to 40%, $$\eta = Ap/Af \cdot 100 \qquad \text{Expression 3}$$

wherein $\eta$ indicates the hold up ratio (%), Ap indicates a cross-sectional area ($m^2$) occupied by the terephthalic acid with respect to a free cross-sectional area, and Af indicates a free cross-sectional area ($m^2$) as a result of subtracting a cross-sectional area of all of the heating tubes from the entire cross-sectional area of the rotating shell.

(Operation and Effect)

If the hold up ratio $\eta$ is 20 to 40%, a processing amount per unit cross-sectional area becomes large, and besides, the drying rate also becomes fast. Further, since the upper limit of the hold up ratio $\eta$ is not excessively large, good drying rate is provided. A more preferable hold up ratio $\eta$ is 25 to 30%. Note that the entire cross-sectional area Af of the rotating shell indicates a cross-sectional area of the inside of the rotating shell at an arbitrary transverse section of the rotating shell, and does not include an area of a thick wall portion of the rotating shell. Specifically, the entire cross-sectional area Af indicates a cross-sectional area calculated based on an inside diameter of the rotating shell.

<Invention Described in claim 4>

In the drying method for terephthalic acid described in claim 1, a plurality of the heating tubes are arranged in a radial manner or on concentric circles, and a separation distance between adjacent heating tubes is 60 to 150 mm.

(Operation and Effect)

The separation distance between the adjacent heating tubes relates to an amount by which the terephthalic acid is scooped up in accordance with the rotation of the rotating shell, and an amount by which the scooped-up terephthalic acid falls to return to a position between the heat transfer tubes, and besides, these amounts are associated with the rotation speed of the rotating shell as well, and it was found out that the separation distance of 60 to 150 mm is suitable.

<Invention Described in claim 5>

A horizontal rotary dryer, including: a rotating shell having a feed port for terephthalic acid on one end side thereof and a discharge port for terephthalic acid on the other end side thereof, and capable of freely rotating around an axial center; and a group of heating tubes through which a heating medium passes, provided within the rotating shell, configured in a manner that the terephthalic acid is lifted up in a rotational direction by the group of heating tubes in accordance with the rotation of the rotating shell, and drying, through indirect heating, the terephthalic acid by using the group of heating tubes in a process of feeding the terephthalic acid to the one end side of the rotating shell and discharging the terephthalic acid from the other end side of the rotating shell, in which the rotating shell is configured to be able to rotate to make a critical speed ratio $\alpha$ defined by the following expression 1 and expression 2 become 17 to less than 80%, $$Vc = 2.21 D^{1/2} \qquad \text{Expression 1}$$

$$\alpha = V/Vc \cdot 100 \qquad \text{Expression 2}$$

wherein Vc indicates a critical speed (m/s) of the rotating shell, D indicates an inside diameter (m) of the rotating shell, $\alpha$ indicates the critical speed ratio (%) of the rotating shell, and V indicates a rotation speed (m/s) of the rotating shell.

(Operation and Effect)

From a viewpoint of the apparatus, operation and effect similar to those of claim 1 are obtained.

<Invention Described in claim 6>

In the horizontal rotary dryer described in claim 5, the horizontal rotary dryer is provided in a manner that a rotation axis of the rotating shell is inclined with respect to a horizontal plane, and the one end side of the rotating shell is positioned higher than the other end side of the rotating shell, in which an inclination angle between the rotation axis and the horizontal plane is 0.057 to 2.86 degrees.

(Operation and Effect)

When the rotating shell is rotated so that the critical speed ratio $\alpha$ of the rotating shell becomes 17 to less than 80%, the rotation speed of the rotating shell is faster than the conventional rotation speed, so that propulsive force for moving the terephthalic acid from the one end side to the other end side becomes stronger than the conventional propulsive force.

Generally, the rotating shell of the horizontal rotary dryer is provided by being inclined with respect to the horizontal plane. This is for allowing a processing material (terephthalic acid or the like) to easily move from the one end side to the other end side. When the propulsive force for moving the processing material from the one end side to the other end side is weak, this inclination angle has to be increased, but, when the propulsive force is strong as in the present invention, this inclination angle can be reduced. There is an advantageous point that as the inclination angle is reduced, a size of a part which supports an axial load applied to the rotating shell (thrust roller) can be further reduced, and thus the cost of the part can be reduced.

Although the inclination angle of the rotating shell of the general horizontal rotary dryer is 0.57 to 5.7 degrees, the inclination angle can be set to 0.057 to 2.86 degrees in the present invention.

Effect of the Invention

As described above, according to the present invention, it is possible to improve the drying rate of the terephthalic acid dried by the dryer. Further, as a result of the improved drying rate, it is possible to increase the drying processing amount per size (shell diameter) of the dryer. Conversely, it is possible to reduce the size of the apparatus per processing amount.

BRIEF DESCRIPTION OF DRAWINGS

FIG. 27 is a table which explains adhesive properties of processing materials.

BEST MODE FOR CARRYING OUT THE INVENTION

Figure 1A:
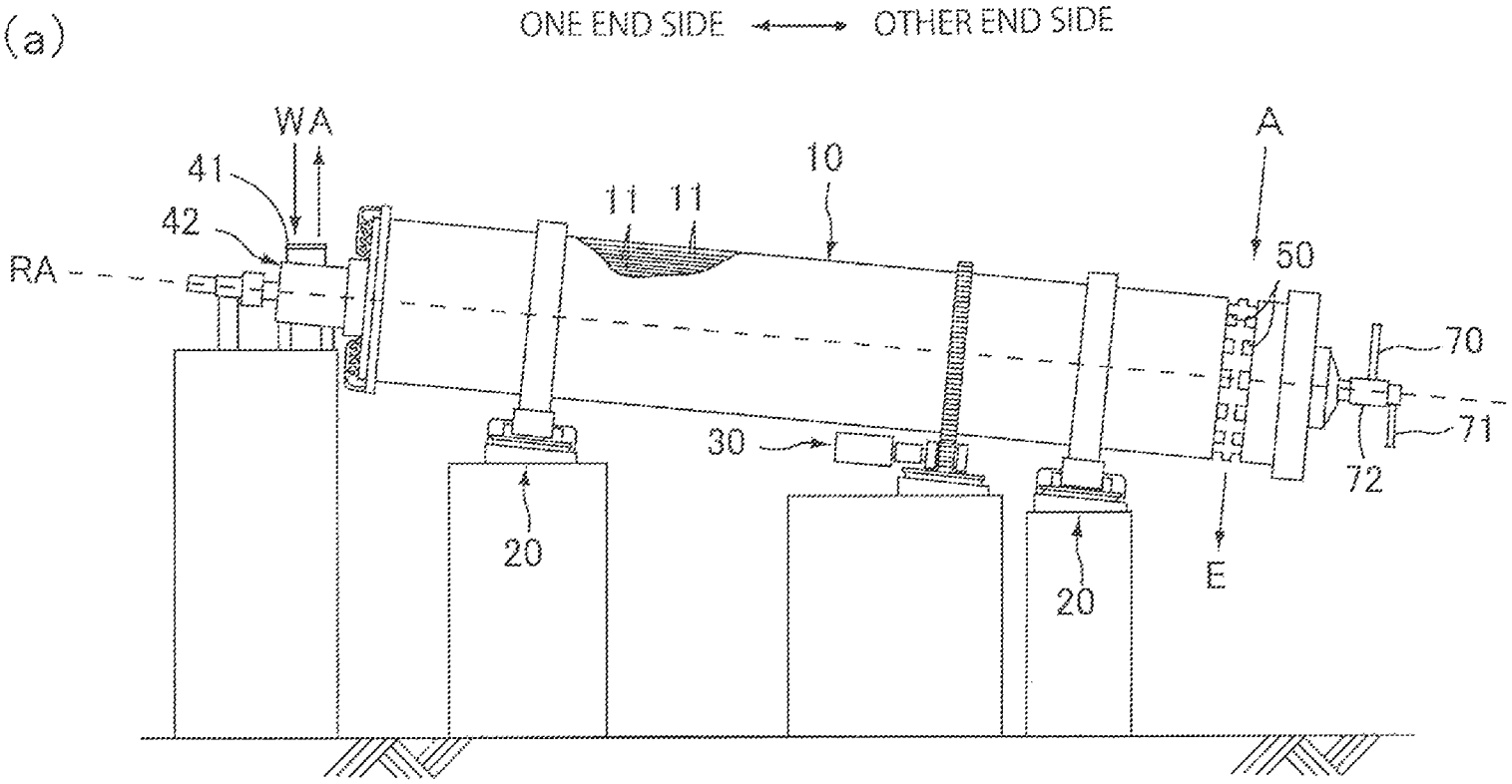
FIG. 1(*a*) is a side view of a horizontal rotary dryer according to the present invention, and FIG. 1(*b*) is a view illustrating an inclination angle between a rotation axis of a rotating shell and a horizontal plane.

Hereinafter, preferred embodiments of the present invention will be further described by using the drawings. Note that the following description and drawings merely illustrate one example of the embodiments of the present invention, and the contents of the present invention should not be construed as being limited to the embodiments.

(Gist of Invention)

Generally, a drying rate of a processing material W dried with a dryer can be represented as the following expression 4, $$Q=Uoa\times Aef\times Tln \quad \text{Expression 4}$$

wherein Q indicates a heat transfer amount (W), Uoa indicates an overall heat transfer coefficient ($W/m^2$–K), Aef indicates an effective contact heat transfer area ($m^2$), and Tln indicates a temperature difference (° C.).

The drying rate is synonymous with the heat transfer amount Q, and in order to increase the heat transfer amount Q on the left side of the aforementioned expression 4, it is only required to take a measurement such that any one or all of the overall heat transfer coefficient Uoa, the effective contact heat transfer area Aef, and the temperature difference Tln on the right side of the expression 4 is/are increased.

The present inventor focused attention on the overall heat transfer coefficient Uoa and the effective contact heat transfer area Aef, and considered, in order to increase these, providing a faster relative contact speed between a heat transfer surface and the material to be dried, and providing a larger effective contact heat transfer area between the heat transfer surface and terephthalic acid by improving dispersion of the terephthalic acid. When various experiments and studies were actually conducted, it was possible to clearly confirm the effectiveness of the method of the present invention.

Besides, as a result of analyzing the high-speed rotation technique according to the present invention in detail, it was found out that the idea of the present invention can be applied also to a case where a diameter of a rotating shell 10 of a dryer is different.

(Terephthalic Acid)

First, as the processing material W (drying target), there can be cited terephthalic acid (1,4-benzene-dicarboxylic acid). The terephthalic acid can be manufactured when paraxylene is subjected to liquid-phase air oxidation. Concretely, air is oxidized under conditions where a temperature is lowered and a pressure is high, in a solvent of acetic acid, by using cobalt or manganese as a catalyst and a bromine compound as a promoter. Other than the above, the terephthalic acid can also be manufactured through a nitric acid oxidation method using paraxylene as a raw material, Henkel process using phthalic acid or potassium salt of benzoic acid as a raw material, or the like.

Although the processing material W is referred to as the terephthalic acid in the above description, correctly, it is a dehydrated cake containing the terephthalic acid. The dehydrated cake corresponds to a cake obtained after performing dehydration in a solid-liquid separator or the like during a dehydration process which is performed before a drying process.

Note that the horizontal rotary dryer according to the present invention can be used for manufacturing crude terephthalic acid and purified terephthalic acid.

A manufacturing method of crude terephthalic acid and purified terephthalic acid is disclosed in Japanese Patent Application Laid-open No. 2009-203163. In the manufacturing method of the crude terephthalic acid, paraxylene to be a raw material is first oxidized in a solvent made of acetic acid using an oxidation reactor, to thereby generate terephthalic acid. The terephthalic acid is crystallized in a crystallization tank to obtain primary slurry. The primary slurry is introduced into a solid-liquid separator to separate the slurry into a separated mother liquid and a dehydrated cake. The dehydrated cake is dried by a horizontal rotary dryer (steam tube dryer), to thereby obtain crude terephthalic acid crystal.

Next, a process of manufacturing the purified terephthalic acid from the crude terephthalic acid will be described. First, the crude terephthalic acid obtained by using the above-described manufacturing method of the crude terephthalic acid is mixed with water in a mixing tank to be initial slurry. Next, the initial slurry is pressurized by a pump, and then heated by a preheater to be completely dissolved. This solution is mixed with water to be initial slurry, and the initial slurry is pressurized by a pump, and then heated by a preheater to be completely dissolved. This solution is subjected to reduction process using hydrogen in a hydrogenation reactor, to thereby reduce 4-carboxybenzaldehyde being a typical impurity in the crude terephthalic acid to para-toluic acid. This reduction-treated liquid is subjected to pressure release and cooling in a crystallization tank, to thereby crystallize the terephthalic acid to obtain slurry. This slurry is separated into a separated mother liquid and a dehydrated cake by using a solid-liquid separator, and the dehydrated cake is dried in the horizontal rotary dryer, to thereby obtain high-temperature and purified terephthalic acid crystal.

The terephthalic acid fed to the horizontal rotary dryer is preferably one whose surface is not sticky and thus having a low adhesive property. FIG. 27 illustrates a table cited from an explanatory diagram 5 on page 17 of an explanatory manual of Association of Powder Process Industry and Engineering, Japan Standard SAP 15-13, 2013. In the present invention, materials within a region surrounded by a dotted line in FIG. 27, which are, in detail, dried materials, materials in a pendular region, materials in a funicular region 1, materials in a funicular region 2, and materials in a capillary region, are preferably used as the terephthalic acid. Slurry is not suitable since it tends to have extremely high adhesive property.

A liquid content of the terephthalic acid fed to the horizontal rotary dryer is preferably 3 to 19 wt % W.B. Here, the "liquid content" indicates a weight ratio of a sum of weight of solid component (W2) and weight of liquid component adhered to a cake of the terephthalic acid (W1) with respect to the weight of liquid component (W1) (W1/(W1+W2)). The liquid content can be determined through a drying loss method or Karl Fischer's method.

As a method of reducing the liquid content of the terephthalic acid to 19 wt % W.B. or less before the terephthalic acid is fed to the horizontal rotary dryer, it is also possible to employ any one of (A) a method of performing flash dry on the terephthalic acid, (B) a method of performing preliminary drying on the terephthalic acid using a heater, and (C) a method of mixing dried terephthalic acid crystal, as described also in Japanese Patent Application Laid-open No. 2009-203163.

The (A) method of performing flash dry on the terephthalic acid is a method in which a terephthalic acid cake is moved to a compound recovery zone having a pressure lower than a pressure in a separator and a temperature lower than a temperature in the separator, and by internal energy released by the movement, liquid adhered to the cake is evaporated. A difference between the pressure in the separator and the pressure in the compound recovery zone is preferably 0.01 MPa to 2.2 MPa. A difference between the temperature of the cake in the separator and the temperature of the cake discharged to the compound recovery zone is preferably 5° C. to 250° C., more preferably 10° C. to 200° C., and particularly preferably 20° C. to 170° C.

The (B) method of performing preliminary drying on the terephthalic acid using the heater is a method in which the heater provided on the previous stage of a drying apparatus is used to evaporate and remove the liquid contained in the terephthalic acid cake, to thereby reduce the liquid content. A heating temperature is equal to or greater than a boiling point of the liquid, and a heating time may be selected by checking the liquid content.

The (C) method of mixing the dried terephthalic acid crystal is a method in which a terephthalic acid product whose liquid content after drying is 0.12 wt % W.B. or less, preferably 0.10 wt % W.B. or less, is mixed with a terephthalic acid cake which is not yet fed to the dryer and thus having a high water content.

(Median Diameter)

Regarding a median diameter of the present invention, a particle size distribution is measured by using, for example, a laser diffraction type particle size distribution measuring apparatus (for example, SALD-3100, which is a product name manufactured by SHIMADZU CORPORATION), and a particle diameter when an accumulated volume corresponds to 50% is defined as a median diameter ($D_{50}$).

In the present invention, the median diameter of the terephthalic acid fed to the horizontal rotary dryer is 50 μm to 250 μm, and the median diameter of dried terephthalic acid (processed material E) discharged from the horizontal rotary dryer is 40 μm to 250 μm.

(Indirect Heating Horizontal Rotary Dryer)

Next, a horizontal rotary dryer according to the present invention (which is also referred to as "STD (abbreviated name of Steam Tube Dryer)", hereinafter) will be described. The horizontal rotary dryer has a structure as exemplified in FIG. 1, in which a cylindrical rotating shell 10 is provided, the rotating shell 10 is installed so that its axial center RA slightly inclines with respect to a horizontal plane HP, and one end of the rotating shell 10 is positioned higher than the other end of the rotating shell 10. In the present invention, an inclination angle θ between the rotation axis RA and the horizontal plane HP is preferably set to 0.057 to 2.86 degrees. At a position below the rotating shell 10, two support units 20 and a motor unit 30 are installed so as to support the rotating shell 10, and the rotating shell 10 is designed to be able to freely rotate around its axial center with the use of the motor unit 30. The rotating shell 10 is designed to rotate in one direction. The direction can be arbitrarily determined, and, for example, it is possible to make the rotating shell 10 rotate counterclockwise (in an arrow mark R direction) when looking at one end side (a feed port side of terephthalic acid) from the other end side (a discharge port side of terephthalic acid).

Inside the rotating shell 10, a large number of steam tubes (heating tubes) 11 each being a pipe made of metal, are attached to extend along the axial center of the rotating shell 10, as heat transfer tubes for the material to be dried. A plurality of the steam tubes 11 are arranged in a circumferential direction and in a radial direction, respectively, so as to form concentric circles around the axial center of the rotating shell 10, for example. Forms of the arrangement will be described later in detail. Note that the heating tubes 11 are warmed when steam or the like being a heating medium flows through the inside of the heating tubes 11. An amount of the heating medium which flows through the inside of the heating tubes 11 is 0.001 $m^3/s$ to 13 $m^3/s$. A temperature in the rotating shell 10 is 20° C. to 235° C., and a temperature of an outer surface of each of the warmed heating tubes 11 is 100° C. to 235° C. Further, a pressure in the rotating shell 10 is −300 mmH2O to +100 mmH2O. Further, a temperature of the terephthalic acid fed to the rotating shell 10 is 50° C. to 235° C., preferably 50° C. to 100° C., and a temperature of the terephthalic acid discharged from the rotating shell 10 is 50° C. to 235° C.

Figure 1B:
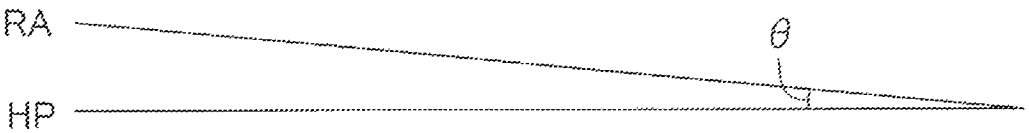
Figure 3:
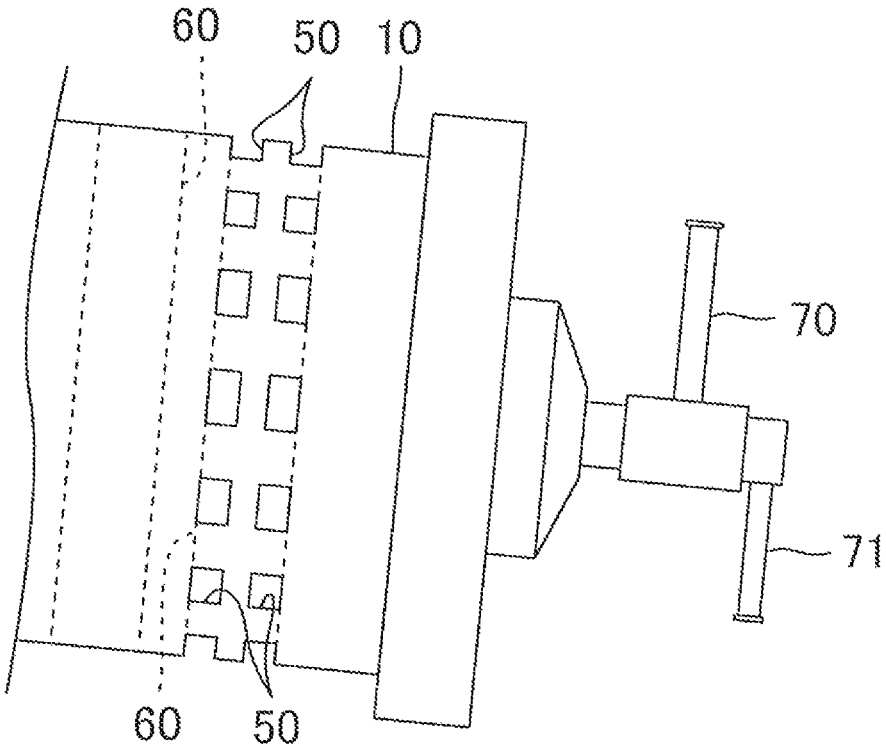
FIG. 3 is an enlarged view (side view) of the other end side of the rotating shell.

As illustrated in FIG. 1 and FIG. 3, on a peripheral wall on the other end side of the rotating shell 10, a plurality of openings 50 are penetrated to be formed. A plurality of the openings 50 are formed along the circumferential direction of the rotating shell 10, and in the examples of FIG. 1 and FIG. 3, the openings 50 are formed by being separated from one another so as to make two lines. Further, all of the plurality of openings 50 are formed in the same shape, but, they may also be formed in different shapes.

Figure 4:
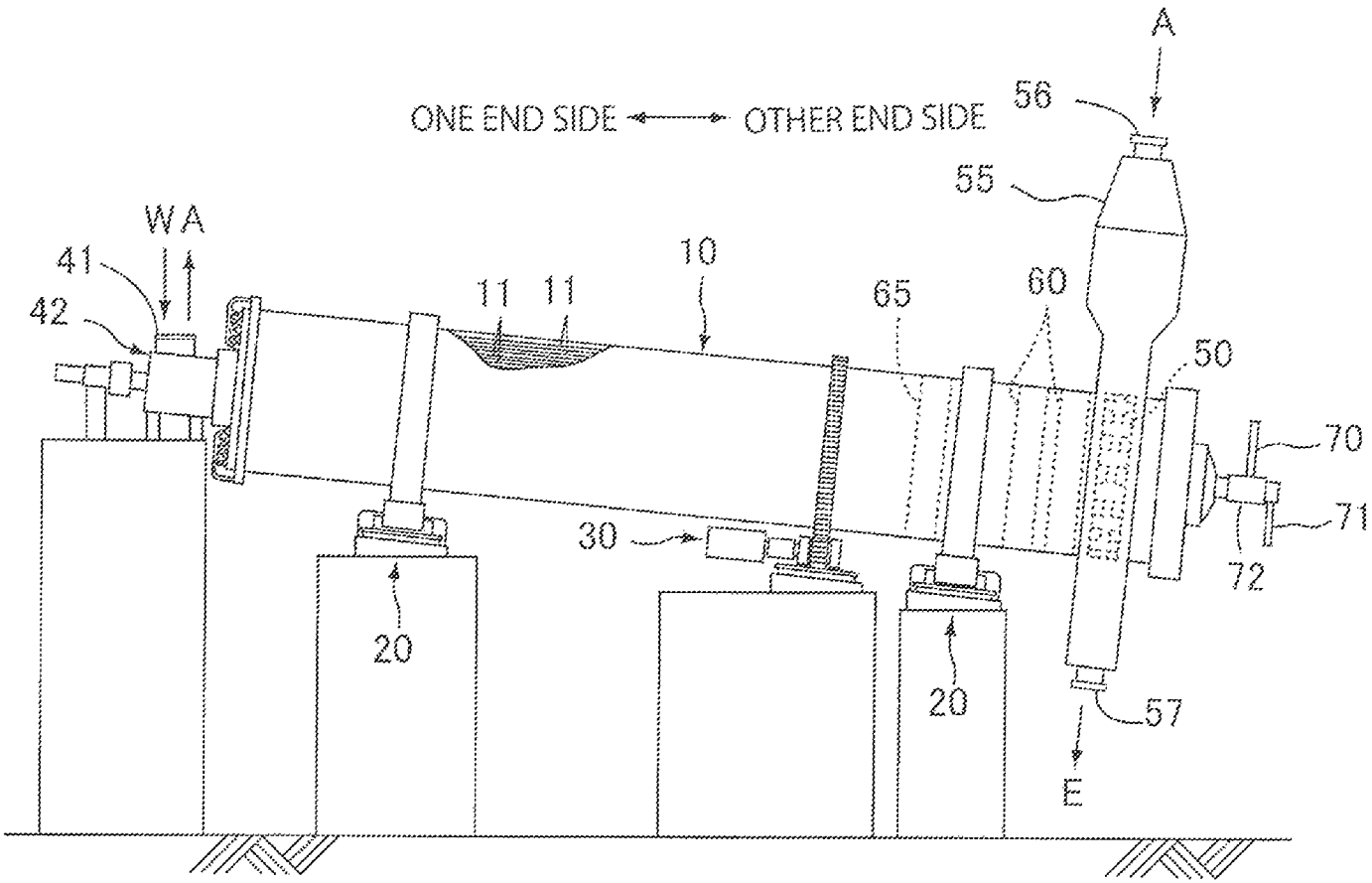
FIG. 4 is a side view of a horizontal rotary dryer (modified example) according to the present invention.

In FIG. 1, the openings. 50 are illustrated in a manner that they can be visually recognized, but, actually, they are covered by a classification hood 55 illustrated in FIG. 4 or the like, for example. At a lower portion of the classification hood 55, there is formed a discharge port 57 from which the processed material E is discharged.

Further, at an upper portion of the classification hood 55, there is formed an air inlet 56 for carrier gas A (air, inert gas, or the like). In this case, the carrier gas A passes through the openings 50 to flow through a space in the rotating shell 10 (in detail, a space between an inside wall of the rotating shell 10 and an outside wall of each of the heating tubes 11) from the other end side to the one end side of the rotating shell 10.

Meanwhile, on the one end side of the rotating shell 10, an opening 41 is provided. This opening 41 is used as not only a feed port for the terephthalic acid, but also an exhaust gas opening for the carrier gas A. Note that it is also possible that the feed port for the terephthalic acid and the exhaust gas opening for the carrier gas are provided separately.

The carrier gas A flowed through the inside of the rotating shell 10 to the one end side is discharged to the outside of the machine through the opening 41.

The horizontal rotary dryer used for drying the terephthalic acid preferably employs "countercurrent flow" in which an advancing direction of the terephthalic acid and an advancing direction of the carrier gas A in the rotating shell 10 are opposite. In a cocurrent flow system, carrier gas on the other end side of the dryer contains a large amount of vapor evaporated from the terephthalic acid, and thus the vicinity of the other end side of the dryer has high humidity, resulting in that a water content in the terephthalic acid is difficult to be lowered. In contrast, in the countercurrent flow system, the carrier gas is blown from the other end side of the dryer, so that the carrier gas does not contain vapor evaporated from the terephthalic acid almost at all, resulting in that the vicinity of the other end side of the dryer has low humidity. For this reason, by employing the countercurrent flow system, there is an advantageous point that the water content in the terephthalic acid discharged from the other end side of the dryer can be further reduced, when compared to the cocurrent flow system.

Figure 10:
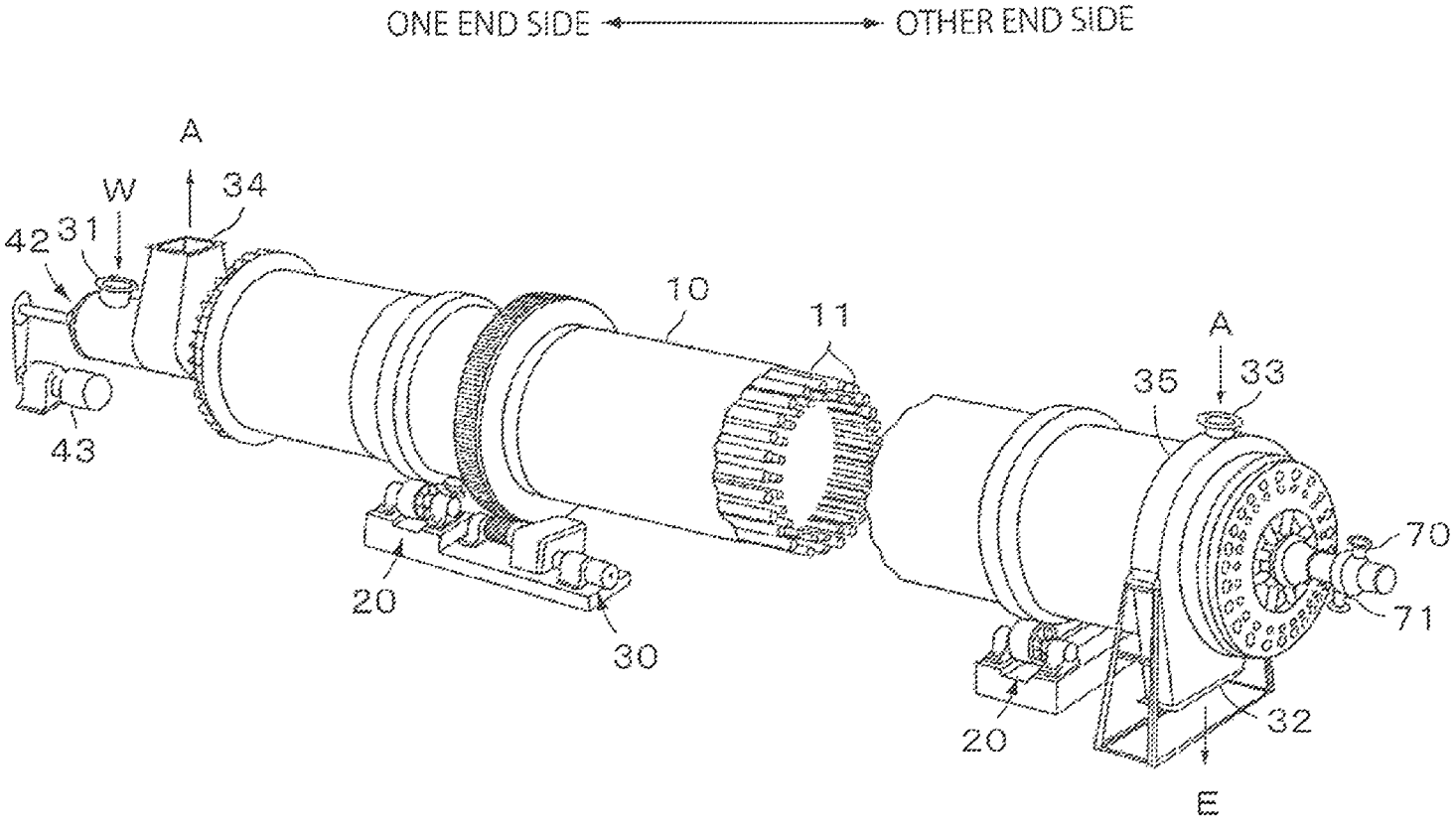
FIG. 10 is a perspective view of a horizontal rotary dryer.

A perspective view of a horizontal rotary dryer employing the "countercurrent flow" is illustrated in FIG. 10. This horizontal rotary dryer, having a shape slightly different from the shape of the horizontal rotary dryer in FIG. 1, has a feed port 31 for the terephthalic acid provided above a screw feeder 42, and has a discharge port 32 for the processed material E provided at a lower end of a hood 35. Further, the terephthalic acid is fed from the feed port 31 to be moved from one end side to the other end side of the rotating shell 10, the terephthalic acid is heated to be dried by the heating tubes 11 through the movement process, and the dried processed material E is discharged from the discharge port 32. Meanwhile, a feed port 33 for the carrier gas A is provided at an upper end of the hood 35, and a discharge port 34 for the carrier gas A is provided above the screw feeder 42. Further, the carrier gas A is fed from the feed port 33, and flowed from the other end side to the one end side of the rotating shell 10, the carrier gas conveys steam evaporated from the terephthalic acid during a process of the flow, and the carrier gas A accompanied by the steam is discharged from the discharge port 34.

Figure 11:
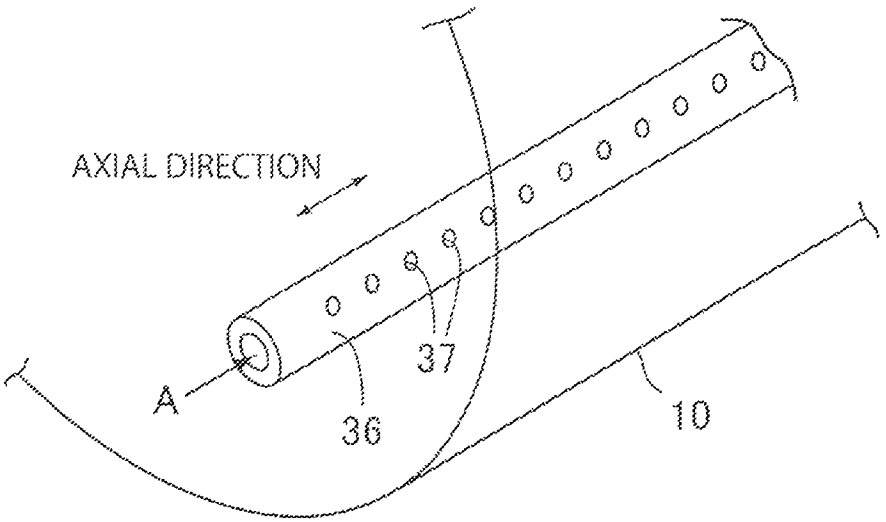
FIG. 11 are explanatory diagrams of a horizontal rotary dryer of a type employing a gas blowing pipe, in which FIG. 11(*a*) is a sectional view of the gas blowing pipe, and FIG. 11(*b*) is a perspective view in which the gas blowing pipe is arranged in the dryer.
Figure 11:
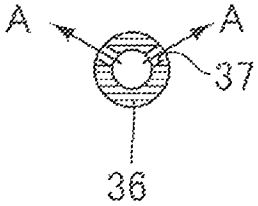

Other than the above, it is also possible to use a horizontal rotary dryer of a type employing a gas blowing pipe, as illustrated in FIG. 11. A gas blowing pipe 36 is provided inside the rotating shell 10 to extend in the axial direction, and rotates together with the rotating shell 10 and the heating tubes 11. For example, the gas blowing pipe 36 can be provided between the plurality of heating tubes 11, 11, or at a position further on the inner side relative to the heating tubes 11 positioned on the innermost side. Note that in FIG. 11, the illustration of the heating tubes 11 is omitted, for easier understanding of the gas blowing pipe 36. On a wall surface of the gas blowing pipe 36, a plurality of gas blowout openings 37 are opened. In the example of FIG. 11, the gas blowout openings 37 are provided in two lines in an axial direction, at upper portions of the gas blowing pipe 36.

When the above-described dryer of the type employing the gas blowing pipe is operated, the carrier gas A is fed into the gas blowing pipe 36 from the other end side of the rotating shell 10. The fed carrier gas A is blown out into the rotating shell 10 from the gas blowing openings 37, and flows out from the one end side of the rotating shell 10 while being accompanied by the steam generated from the terephthalic acid. Other than the above, it is also possible to employ a configuration in which the carrier gas A is fed into the gas blowing pipe 36 from the one end side of the rotating shell 10, and the gas is exhausted from the other end side of the rotating shell 10.

Further, on the other end side of the rotating shell 10, a gas pipe 72 is provided, and a feed pipe 70 feeding steam into the steam tubes 11 and a drain pipe 71 are provided.

(Drying Process)

Figure 2:
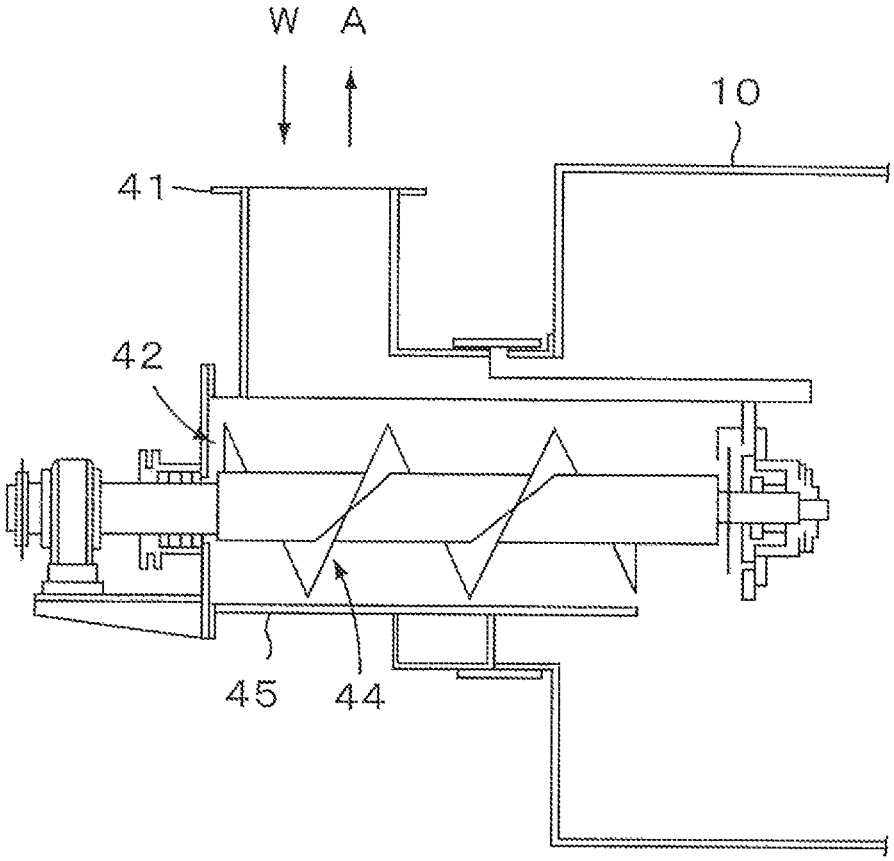
FIG. 2 is a side view illustrating a screw feeder and a periphery thereof.

Next, a process of drying the terephthalic acid in the horizontal rotary dryer will be described while referring to FIG. 1 to FIG. 3.

The terephthalic acid is fed into the screw feeder 42 from the feed port 41, and by turning a screw 44 disposed inside the screw feeder 42 with the use of a not-illustrated driving unit, the terephthalic acid is fed to the inside of the rotating shell 10. The terephthalic acid fed from the feed port 41 moves to the other end side of the rotating shell 10 while being dried by being brought into contact with the outer surfaces of the steam tubes (heating tubes) 11 heated by steam, and is discharged from discharge ports 50. Note that both end portions of the group of heating tubes 11 are connected to the rotating shell 10, so that in accordance with the rotation of the rotating shell 10, the group of heating tubes 11 also rotates together with the rotating shell 10. Further, the terephthalic acid is lifted up in the upper direction by the rotating group of heating tubes 11, and dispersed in a wide range in the rotating shell 10. As will be described later in detail, as the critical speed ratio $\alpha$ of the rotating shell increases, an amount of the terephthalic acid to be lifted up is further increased, resulting in that the terephthalic acid disperses in a wider range in the rotating shell 10.

This horizontal rotary dryer is a dryer in which the terephthalic acid is indirectly heated to be dried because of the contact between the outer surfaces of the heating tubes 11 warmed by the steam (heating medium) and the terephthalic acid. Therefore, this horizontal rotary dryer is fundamentally different, regarding a mechanism of dryer, from a dryer in which the terephthalic acid is directly heated to be dried because of direct contact between a heating medium and the terephthalic acid.

Note that the temperature of the terephthalic acid discharged from the horizontal rotary dryer is 50° C. to 235° C. Further, the liquid content (the weight ratio of the liquid adhered to cake to the solid component) can be lowered to 1 wt % W.B. or less, preferably 0.1 wt % W.B. or less by the horizontal rotary dryer.

Further, the steam fed into the heating tubes 11 from the feed pipe 70 is cooled in a process of flowing through the inside of the heating tubes 11, when the terephthalic acid and the heating tubes 11 are brought into contact with each other to perform heat exchange, and the steam is turned into liquid D to be discharged from the drain pipe 71.

(Modified Example of Feed System)

A modified example of the horizontal rotary dryer according to the present invention will be described.

Figure 5:
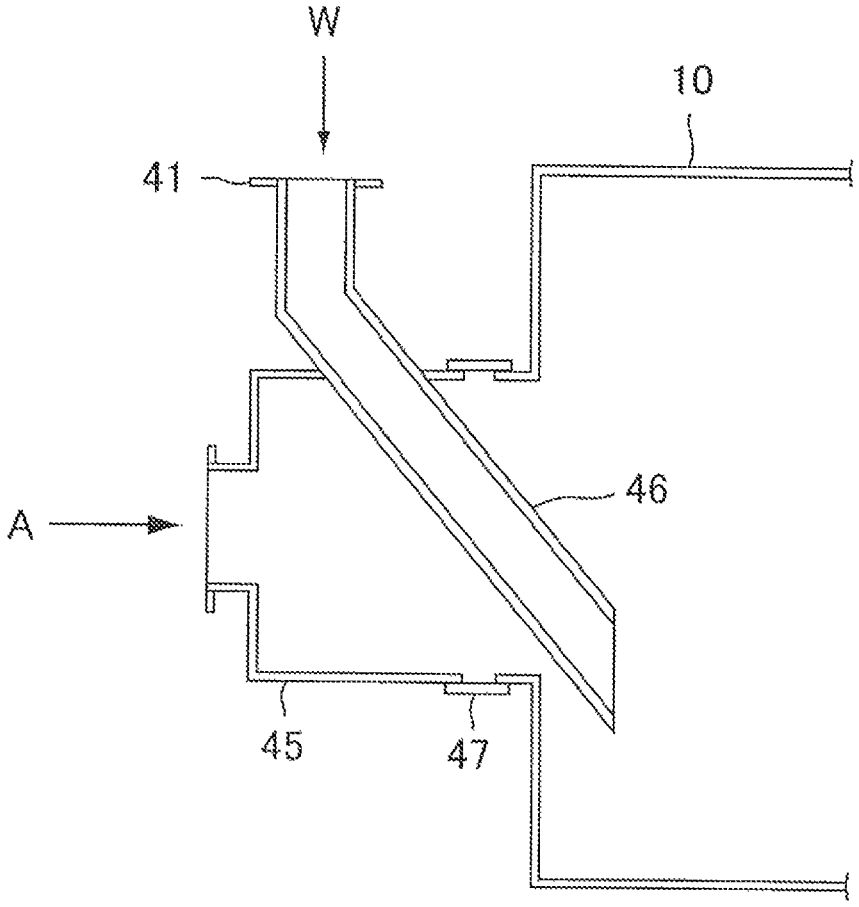
FIG. 5 is a side view illustrating a case where a feed system is one of chute type.
Figure 6:
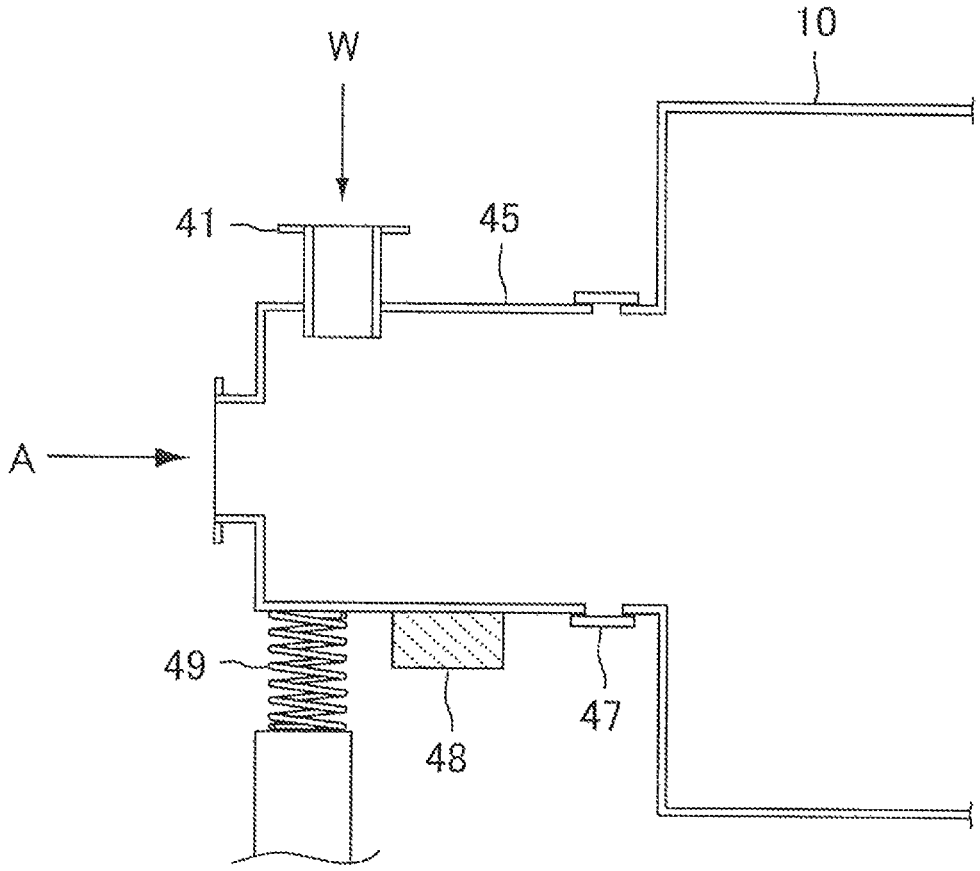
FIG. 6 is a side view illustrating a case where the feed system is one of vibration trough type.

As a system of feeding the terephthalic acid to the horizontal rotary dryer, there can be exemplified one of, other than the aforementioned screw type (FIG. 2), a chute type (FIG. 5) or a vibration trough type (FIG. 6). In the chute type, a feed chute 46 is coupled to an intake box 45, and the terephthalic acid fed from the feed port 41 falls in the feed chute 46 to move to the inside of the rotating shell 10. The intake box 45 is connected to the rotating shell 10 via a seal packing 47, and it is structured in a manner that the rotating shell 10 rotates while maintaining sealing between the rotating shell 10 and the intake box 45. In the vibration trough type, the intake box 45 has a trough shape (recessed cross-sectional shape), and a vibration motor 48 and a spring 49 are coupled to a lower end of the intake box 45. The terephthalic acid fed from the feed port 41 falls on the trough. Further, when the intake box 45 is vibrated by the vibration motor 48, the terephthalic acid moves to the inside of the rotating shell 10. It is preferable that when the intake box 45 is attached, the intake box 45 is inclined downward toward the rotating shell 10 in order to allow the easy movement of the terephthalic acid.

(Modified Example of Rotating Shell)

Figure 7:
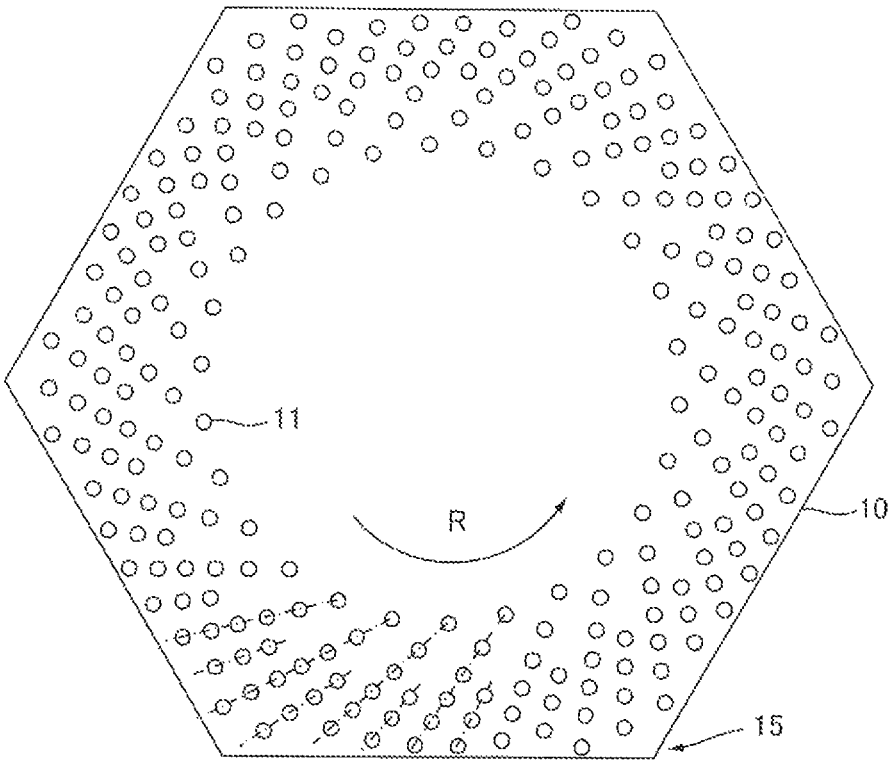
FIG. 7 illustrates an example in which a shape of a transverse section of the rotating shell is set to a rectangular shape.

The cross-sectional shape of the rotating shell 10 may be set to a rectangular shape, other than a circular shape to be described later. As an example of the rectangular shape, the rotating shell 10 in a hexagonal shape is illustrated in FIG. 7. When the rectangular rotating shell 10 is rotated, the terephthalic acid is raised by corner portions 15 of the rotating shell 10, which realizes better mixing of the terephthalic acid. Meanwhile, since the cross-sectional area of the rotating shell 10 becomes narrow when compared to a case where the circular rotating shell 10 is employed, there also exists a demerit such that the number of heating tubes 11 to be arranged is reduced. Note that the number of corner portions (number of sides) of the rectangular shape can be changed, and in more detail, the number of corner portions can be set to an arbitrary number of three or more.

Figure 8:
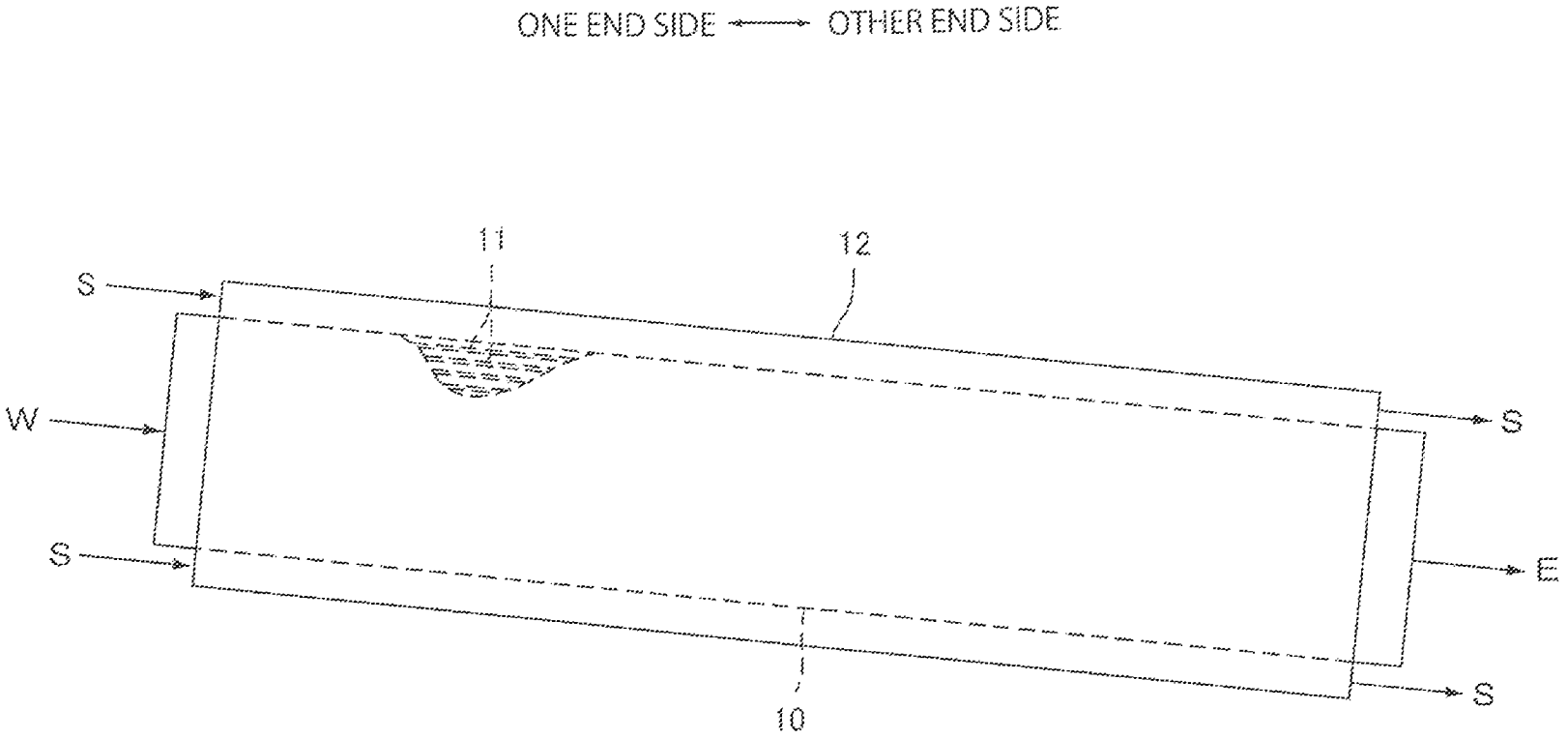
FIG. 8 is a side view illustrating a case where a jacket is provided on the outside of the rotating shell.

As illustrated in FIG. 8, it is also possible to provide a jacket 12 surrounding the rotating shell 10. In this case, a heating medium S is flowed between an outside wall of the rotating shell 10 and an inside wall of the jacket 12, to thereby perform heating also from the outside of the rotating shell 10. As a result of this, it is possible to increase the drying rate of the terephthalic acid, when compared to a case where the jacket 12 is not provided. As an example of the heating medium S, there can be cited high temperature gas at 200 to 400° C., hot oil at 200 to 400° C., or the like. Other than the above, it is also possible to provide, instead of the jacket 12, a plurality of trace pipes (not illustrated) so as to surround the rotating shell 10.

(Modified Example of Discharge System)

Figure 9:
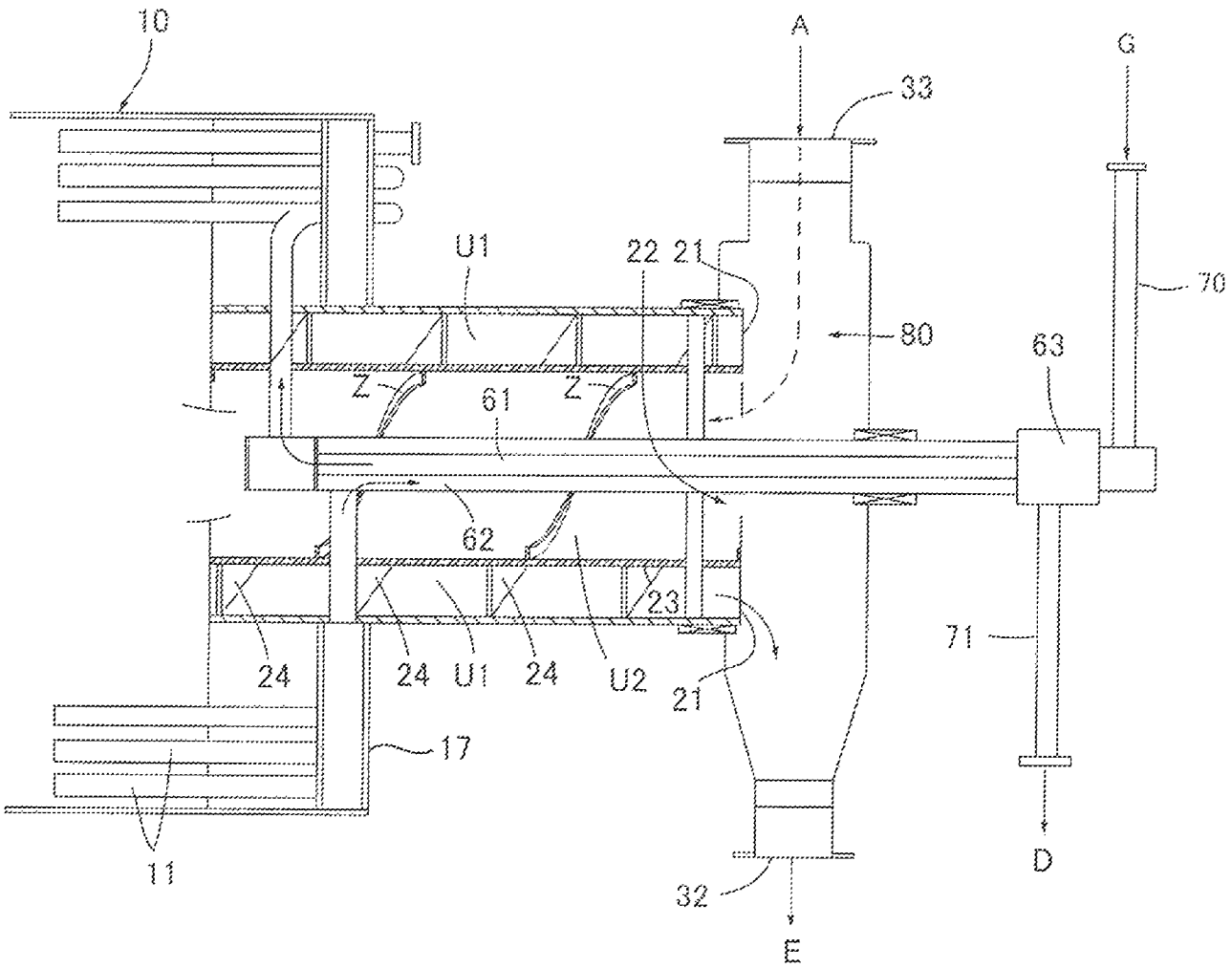
FIG. 9 is a side view illustrating a modified example of a discharge system for processed material.

As a system of discharging the processed material E from the horizontal rotary dryer, a configuration as illustrated in FIG. 9 can also be employed. In such a configuration, the carrier gas A is sent to the inside a partition wall 23 from a carrier gas feed port 33 at an upper portion of a casing 80. When the carrier gas A is reused gas, the carrier gas A contains powder dust and the like, but, since ribbon screws Z are arranged inside the partition wall 23, namely, in a gas passage U2, the power dust and the like mixed in the gas are captured by the ribbon screws Z. The captured powder dust and the like are sent toward an opening 22 because of a transfer action of the ribbon screws Z, and discharged to the inside of the casing 80. The discharged powder dust and the like freely fall to be discharged from the discharge port 32 at a lower portion of the casing. In contrast, gas as a result of removing the powder dust and the like from the carrier gas A is sent to the inside of the rotating shell 10 without being prevented by the ribbon screws Z.

Further, screw blades 24 also rotate in accordance with the rotation of the rotating shell 10. Therefore, the dried material E as a result of drying the terephthalic acid is sent, in a delivery passage U1, toward an opening 21 because of a transfer action of the screw blades 24, and is discharged from the opening 21. The discharged dried material E is discharged, by its own weight, from the discharge port 32 at the lower portion of the discharge casing.

On the other hand, a steam path (formed of an internal steam feed pipe 61 and an internal drain discharge pipe 62) penetrating through the casing 80 and extending to the inside of the partition wall 23, is integrally provided with the rotating shell 10. The internal steam feed pipe 61 is communicated with an entrance header portion for the heating tubes 11 of an end plate part 17, and the internal drain discharge pipe 62 is communicated with an exit header portion for the heating tubes 11 of the end plate part 17. Further, a steam feed pipe 70 and a drain discharge pipe 71 are connected to the internal steam feed pipe 61 and the internal drain discharge pipe 62, respectively, via a rotary joint 63.

(Modified Example of Rotating Shell Supporting Structure)

Other than the above, the supporting structure of the rotating shell 10 may also employ, other than the aforementioned supporting structure in which two tire members 20, 20 are attached to the outer periphery of the rotating shell 10, a structure in which bearings (not illustrated) are attached to outer peripheries of a screw casing 42 provided on one end side and the gas pipe 72 provided on the other end side, and the bearings are supported, or a supporting structure realized by combining the tire members 20 and the bearings.

(Rotation Speed)

In the present invention, the rotating shell 10 is rotated at a speed faster than that in the conventional horizontal rotary dryer, in order to increase the drying rate of the terephthalic acid. A method of deciding the rotation speed will be described hereinafter.

(Process 1)

A processing load PL of the horizontal rotary dryer is decided. Concretely, the load PL is calculated based on a type of the terephthalic acid, the liquid content (wt % W.B.), a targeted processing amount (kg/h), and the like.

(Process 2)

A small-sized horizontal rotary dryer is used as an experimental machine, to examine a drying rate Rd of the terephthalic acid per unit load.

(Process 3)

A size of the rotating shell 10 is decided based on the drying rate Rd of the terephthalic acid examined in the process 2.

(Process 4)

A number of rotations of the rotating shell 10 is decided. A conventional method of deciding the number of rotations uses, as an important criterion, a rotation speed of the rotating shell 10 (in the present invention, "rotation speed" is also referred to as "circumferential speed"), and concretely, the number of rotations has been decided by using the following expression 5. Note that a value of rotation speed V has been decided based on empirical rule within a range of about 0.1 to 0.7 [m/s].

$$N=(V\times 60)/(D\times\pi) \qquad \text{Expression 5}$$

Here, N indicates the number of rotations (r.p.m.) of the rotating shell 10, V indicates the rotation speed (m/s) of the rotating shell 10, and D indicates an inside diameter (m) of the rotating shell 10.

In the present invention, the number of rotations is decided based on, not the aforementioned expression 5, but a critical speed ratio, and concretely, the number of rotations is decided by using the following expression 6, $$N=V/Vc\times Nc \qquad \text{Expression 6}$$

wherein N indicates the number of rotations (r.p.m.) of the rotating shell 10, V indicates the rotation speed (m/s) of the rotating shell 10, Vc indicates a critical speed (m/s) of the rotating shell 10, and Nc indicates a critical number of rotations (r.p.m.) of the rotating shell 10.

(Critical Speed, Critical Speed Ratio)

Figure 12:
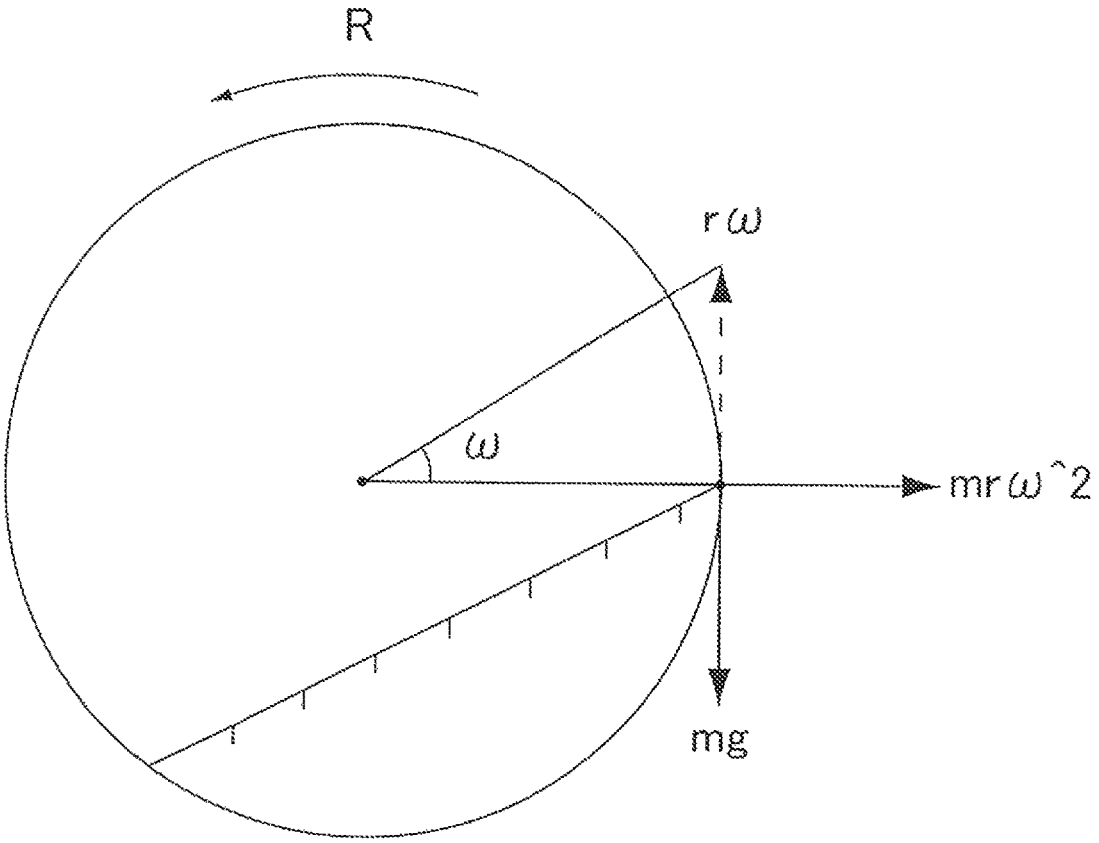
FIG. 12 is an explanatory diagram illustrating a process of deriving a critical speed ratio.

The "critical speed" and the "critical number of rotations" in the aforementioned expression 6 will be described in detail. When FIG. 12 is referred to, the "critical speed" corresponds to a rotation speed at which gravity of the terephthalic acid and centrifugal force acted on the terephthalic acid are balanced in the horizontal rotary dryer, and theoretically indicates a rotation speed of the rotating shell 10 when the terephthalic acid corotates with the rotating shell 10. Note that rω indicates a speed. Further, the "critical speed ratio" indicates a ratio of the actual rotation speed to the critical speed.

(Critical Speed)

The critical speed will be described in detail. At the critical speed, the gravity (mg) of the terephthalic acid and the centrifugal force ($mr\omega^2$) are the same, so that the following expression 7 is satisfied, $$mg=mr\omega^2 \qquad \text{Expression 7}$$

wherein in indicates mass (kg) of the terephthalic acid, g indicates a gravitational acceleration ($m/s^2$), r indicates a radius (m) of the rotating shell 10, and ω indicates an angular speed (rad/s).

Further, the following expression 8 can be derived from the aforementioned expression 7, $$g=r(Vc/r)^2 \qquad \text{Expression 8}$$

wherein g indicates the gravitational acceleration ($m/s^2$), r indicates the radius (m) of the rotating shell 10, and Vc indicates the critical speed (m/s) of the rotating shell 10.

Therefore, it is possible to derive the following expression 1 from the aforementioned expression 8, to thereby determine the critical speed (m/s) of the rotating shell 10, $$Vc=(rg)^{1/2}=(D/2\cdot g)^{1/2}=2.21D^{1/2}$$

$$Vc=2.21D^{1/2} \quad \text{Expression 1}$$

wherein Vc indicates the critical speed (m/s) of the rotating shell 10, and D indicates the inside diameter (m) of the rotating shell 10.

(Critical Speed Ratio)

Next, the critical speed ratio of the rotating shell will be described. The critical speed ratio α of the rotating shell indicates the ratio of the actual rotation speed V to the critical speed (Vc), and thus it can be represented by the following expression 2, $$\alpha=V/Vc\cdot 100 \quad \text{Expression 2}$$

wherein α indicates the critical speed ratio (%) of the rotating shell 10, V indicates the rotation speed (m/s) of the rotating shell 10, and Vc indicates the critical speed (m/s) of the rotating shell 10.

(Critical Number of Rotations)

Note that the number of rotations of the rotating shell 10 at the critical speed is referred to as "critical number of rotations", and can be determined through the following expression 9, $$Nc=Vc\cdot 60/(\pi D)=2.21D^{1/2}\cdot 60/(\pi D)=42.2/D^{1/2}$$

$$Nc=42.2/D^{1/2} \quad \text{Expression 9}$$

wherein Nc indicates the critical number of rotations (r.p.m.) of the rotating shell 10, Vc indicates the critical speed (m/s) of the rotating shell 10, and D indicates the inside diameter (m) of the rotating shell 10.

(Experiment 1: Dispersion State of Terephthalic Acid)

A horizontal rotary dryer having the rotating shell 10 with an inside diameter of 370 mm was used to perform an experiment regarding a relationship between the critical speed ratio α (%) of the rotating shell and the drying rate Rd of the terephthalic acid. A gap K between the heating tubes 11 arranged in the rotating shell 10 is 60 mm.

First, the terephthalic acid having a water content of 9 wt % w.b. was charged into the rotating shell 10 in a batch manner. The median diameter of the terephthalic acid is 120 mm, and a charging amount per one time is 13 kg.

Figure 13:
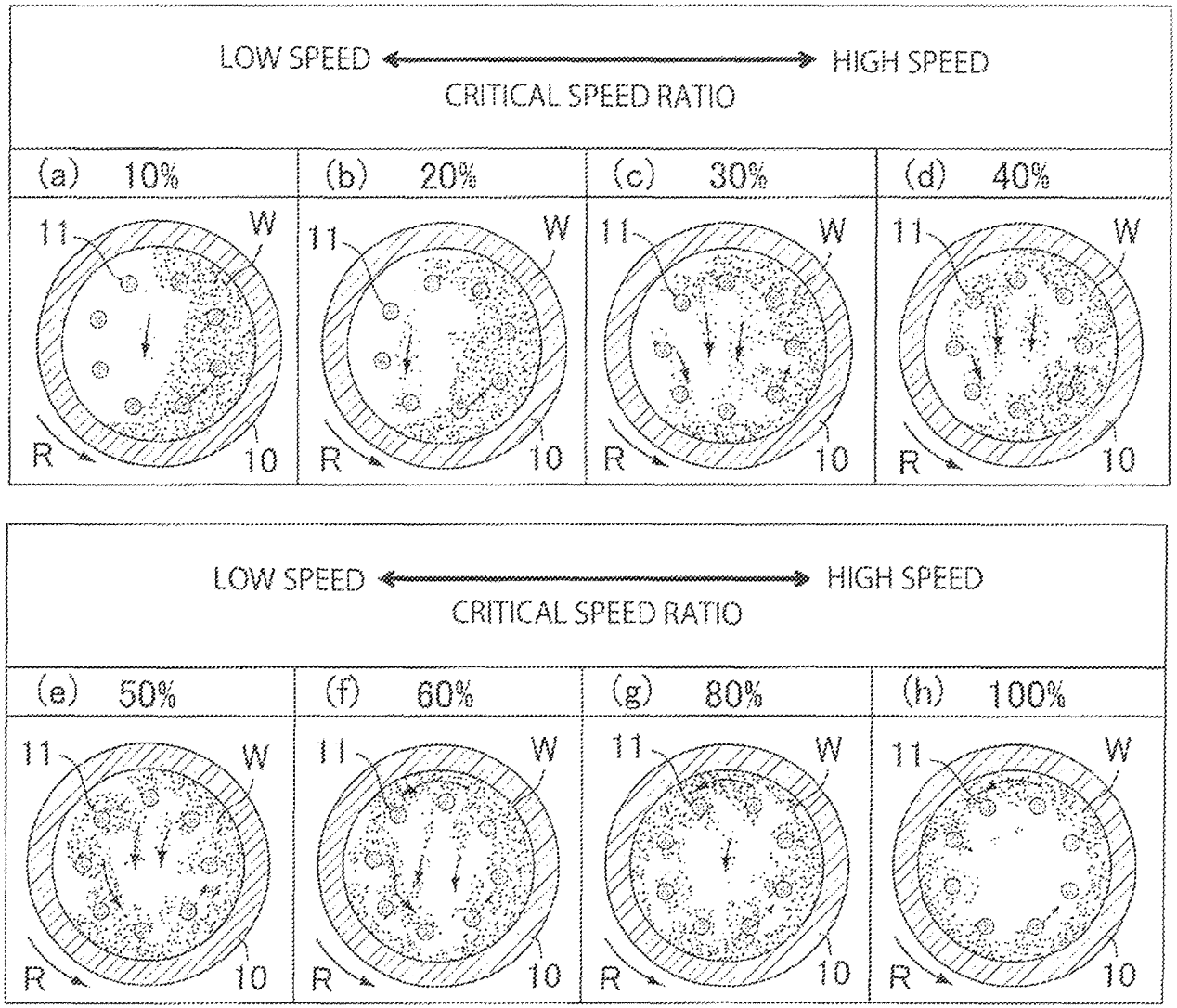
FIG. 13 is a diagram obtained in a manner that a rotating shell is operated while arbitrarily changing the critical speed ratio and a diameter of the rotating shell, dispersion states of terephthalic acid in the inner part of the rotating shell are photographed, and the photographs are traced.

Further, the rotating shell 10 was rotated while arbitrarily changing the critical speed ratio, and dispersion states of the terephthalic acid in the inner part of the rotating shell 10 were photographed. Diagrams obtained by tracing the photographs are illustrated in FIG. 13. Specifically, a transparent plate was provided at a transverse section of the horizontal rotary dryer so that behavior of the terephthalic acid could be visually recognized, the dispersion states of the terephthalic acid in the inner part of the rotating shell 10 were photographed through this transparent plate, and the photographs were traced. Note that the rotational direction of the rotating shell 10 in FIG. 13 is counterclockwise.

When the rotating shell 10 is operated by setting the critical speed ratio to 10%, the terephthalic acid is subjected to kiln action in a region of right half of the rotating shell 10. However, the terephthalic acid exists, in an aggregated state, in the region of right half of the rotating shell 10, and thus a movement amount thereof is small, so that the terephthalic acid is not dispersed very much in a region of left half of the rotating shell 10. This means that the heating tubes 11 and the terephthalic acid are not sufficiently brought into contact with each other in the region of left half in the rotating shell 10.

After that, as the critical speed ratio was gradually increased to 20%, 30%, 40%, and 50%, a range of dispersion of the terephthalic acid was enlarged by degrees, and the range of dispersion of the terephthalic acid reached the region of left half of the rotating shell 10.

Further, when the critical speed ratio was gradually increased to 60%, 80%, and 100%, a phenomenon in which the terephthalic acid adheres to the inside wall of the rotating shell 10 and rotates together with the rotating shell 10 (referred to as "corotation", hereinafter) occurred. This corotation occurs when resultant force between "liquid cross-linking force between free water and free water existed on surfaces of adjacent terephthalic acid particles" and "centrifugal force generated by rotation of rotating shell 10" exceeds "gravity of terephthalic acid (dehydrated cake containing terephthalic acid)". When this corotation occurs, the terephthalic acid becomes difficult to fall from the upper direction to the lower direction in the rotating shell 10, and the mixing state of the terephthalic acid in the rotating shell 10 deteriorates, so that a heat transfer amount from the heating tubes 11 to the terephthalic acid is lowered, and the evaporation rate of the liquid component possessed by the terephthalic acid becomes slow.

According to the aforementioned experiment 1, when the terephthalic acid having the water content of 9 wt % w.b. is dried, the corotation occurs when the critical speed ratio becomes 60% or more, so that it can be predicted that if the critical speed ratio becomes 60% or more, the evaporation rate of the liquid component possessed by the terephthalic acid becomes slow.

Note that in FIG. 13, an arrow mark of solid line illustrated in the rotating shell 10 indicates a direction in which the terephthalic acid falls, and an arrow mark of dotted line indicates a direction in which the heating tubes 11 move.

(Experiment 2: Liquid Content of Terephthalic Acid)

A horizontal rotary dryer having the rotating shell 10 with an inside diameter of 1830 mm was used to perform an experiment regarding a relationship between the critical speed ratio α (%) of the rotating shell and the drying rate Rd of the terephthalic acid. In this experiment, each of four types of samples (terephthalic acid) with different liquid contents was charged into the horizontal rotary dryer in a batch manner. The respective liquid contents of the terephthalic acid include 5 wt % W.B. of terephthalic acid 1, 9 wt % W.B. of terephthalic acid 2, 13 wt % W.B. of terephthalic acid 3, and 17 wt % W.B. of terephthalic acid 4.

Figure 14:
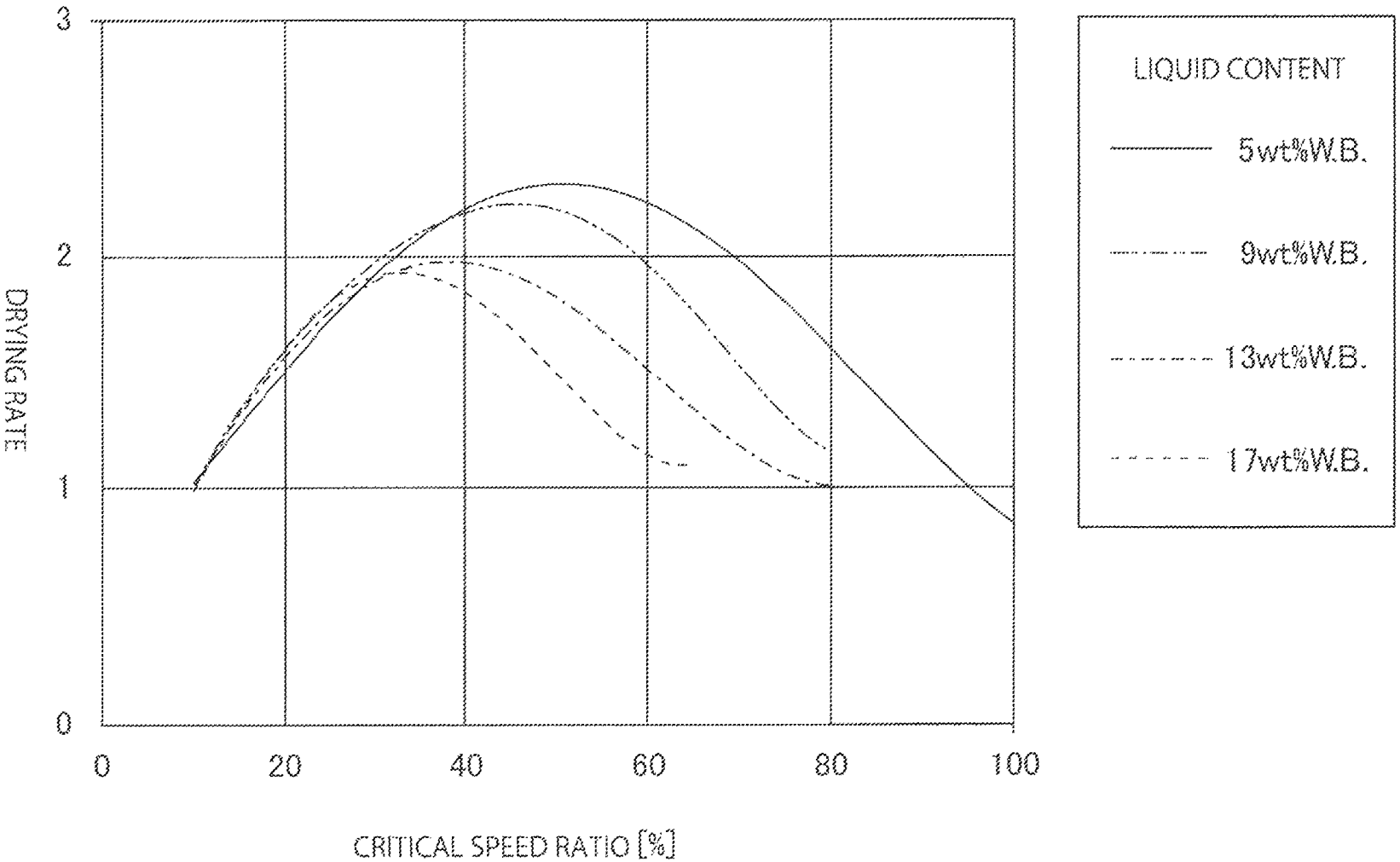
FIG. 14 is a graph illustrating a relationship between the critical speed ratio and a drying rate when a liquid content of fed terephthalic acid is changed.

Results of the above experiment are illustrated in FIG. 14. In FIG. 14, a value of the drying rate of the terephthalic acid when the critical speed ratio α of the rotating shell is 10% is defined as 1 in each sample, and the results are represented by relative numeric values based on the value of 1. When the critical speed ratio α of the rotating shell was gradually increased from 10%, the drying rate became gradually fast regardless of the difference in the liquid contents of the terephthalic acid. Note that when the value of the critical speed ratio was increased regardless of the existence of difference in the liquid contents of the terephthalic acid, the drying rates were increased at the same pace up to a certain point. Further, the drying rates reached their peaks (points where the drying rates become the fastest) at certain critical speed ratios. Further, when the critical speed ratios were further increased from the certain critical speed ratios, the drying rates became gradually slow this time, and were lowered to about 1 being the original value of the drying rate.

In the results of the experiment described above, the critical speed ratio at which the drying rate reached its peak, differed depending on the liquid content of the terephthalic acid. Concretely, as the liquid content of the terephthalic acid became high, the drying rate reached its peak at a smaller critical speed ratio. Further, the lower the liquid content of the terephthalic acid, the higher the value of the peak of the drying rate.

As is apparent from this experimental result as well, the critical speed ratio is preferably set to 17 to 80%, more preferably set to 19 to 70%, and still more preferably set to 25 to 65%. As illustrated in FIG. 14, as the value of the critical speed ratio increases from 10%, the drying rate changes in a mountain form, so that in order to obtain a desired drying rate, it is possible to perform selection from two critical speed ratios including a low critical speed ratio and a high critical speed ratio. For example, when the drying rate of 1.5 is tried to be achieved in the terephthalic acid whose water content is 13 wt % W.B., the following two methods can be selected. The first one is a method of setting the critical speed ratio to 20% (a method of selecting the low critical speed ratio), and the second one is a method of setting the critical speed ratio to 60% (a method of selecting the high critical speed ratio). When there are two alternatives as above, it is preferable to select the low critical speed ratio. This is because as the critical speed ratio becomes low, namely, as the number of rotations of the rotating shell 10 becomes low, further excellent economic efficiency is provided and an environmental burden can be further reduced, since a frequency of replacement of parts due to wear of machine, power consumption, and the like are reduced. Note that in the above-described example, if it is only required that the drying rate is faster than 1.5, it is also possible that the critical speed ratio is set to 40% to set the drying rate to about 2. However, if it is sufficient that the drying rate is 1.5, it is preferable to set the critical speed ratio to 20%, from a viewpoint of the economic efficiency, reduction in environmental burden, and the like described above.

Further, it is preferable that as the liquid content of the terephthalic acid to be fed becomes low, the value of the critical speed ratio is set higher. Concretely, when the liquid content of the terephthalic acid is 5 wt % W.B., the critical speed ratio is preferably set to 19% to 65%, when the liquid content of the terephthalic acid is 9 wt % W.B., the critical speed ratio is preferably set to 19 to 55%, when the liquid content of the terephthalic acid is 13 wt % W.B., the critical speed ratio is preferably set to 19 to 45%, and when the liquid content of the terephthalic acid is 17 wt % W.B., the critical speed ratio is preferably set to 19 to 40%.

Note that as described above, when the value of the critical speed ratio is set to be high, the number of rotations of the rotating shell 10 increases. When the number of rotations of the rotating shell 10 increases, an amount of dust generated in the rotating shell 10 increases, and the generated dust is discharged, to the outside of the dryer, together with the carrier gas which flows in the rotating shell 10. Since a large amount of the terephthalic acid is also included in the dust, it is preferable that the terephthalic acid is recovered to be recycled. Concretely, it is preferable that the carrier gas discharged from the dryer is sent to a solid-liquid separator, the terephthalic acid in the carrier gas is recovered by the solid-liquid separator, and the recovered terephthalic acid is returned to an upstream reaction tank or the like.

Further, with reference to FIG. 14 illustrating the result of the above-described experiment 2, in the case of drying the terephthalic acid with the water content of 9 wt % w.b., when the critical speed ratio becomes 60% or more, the drying rate becomes gradually slow, so that it can be confirmed that the prediction of the experiment 1 that "if the critical speed ratio becomes 60% or more, the evaporation rate of the liquid component possessed by the terephthalic acid becomes slow", is correct.

(Experiment 3: Inside Diameter of Rotating Shell 10)

Figure 15:
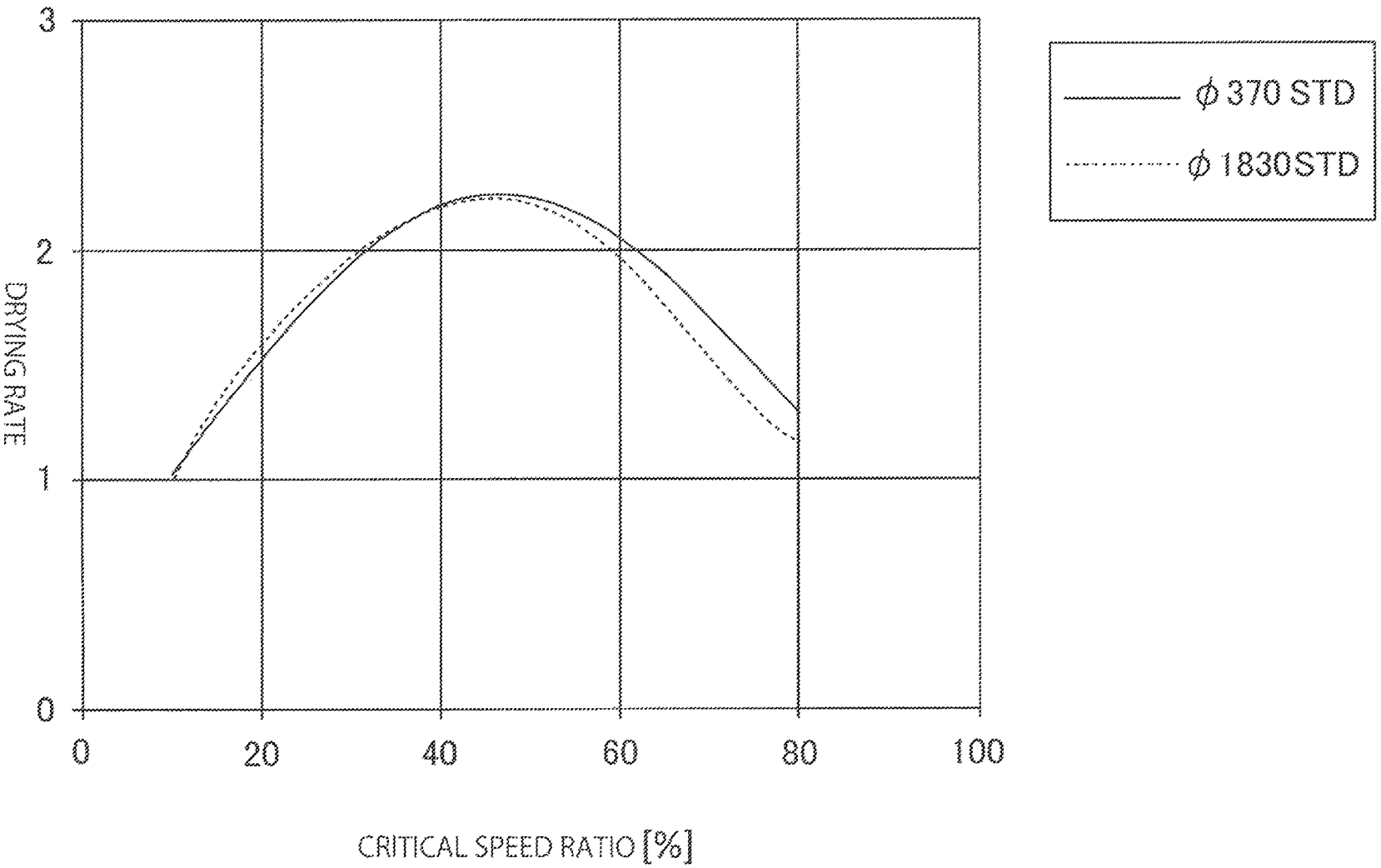
FIG. 15 is a graph illustrating a relationship between the critical speed ratio and the drying rate when the diameter of the rotating shell is changed.

Next, two horizontal rotary dryers with different inside diameters of the rotating shells 10 were used to examine a relationship between the critical speed ratio $\alpha$ (%) of the rotating shell and the drying rate Rd of the terephthalic acid. The inside diameters of the rotating shells 10 are 370 mm and 1830 mm, respectively. In this experiment, the terephthalic acid with the water content of 9 wt % w.b. was charged into the horizontal rotary dryers in a batch manner. Results of the experiment are illustrated in FIG. 15. Note that values of the drying rate in FIG. 15 are relative numeric values. In detail, a value of the drying rate when the critical speed ratio is 10% is defined as 1, and the values of the drying rate are represented by relative numeric values based on the value of 1.

When the critical speed ratio was gradually increased from 10%, the drying rate became gradually fast, and the drying rate became the fastest in a range of 40% to 50% of the critical speed ratio. Further, it was confirmed that when the critical speed ratio was further increased, the drying rate became gradually slow. The change in the drying rate was not changed almost at all even if the inside diameters of the rotating shells 10 were different to be 370 mm and 1830 mm Therefore, it can be understood that the change in the drying rate is not influenced by the inside diameter of the rotating shell 10 almost at all.

(Experiment 4: Hold Up Ratio of Terephthalic Acid)

Figure 16:
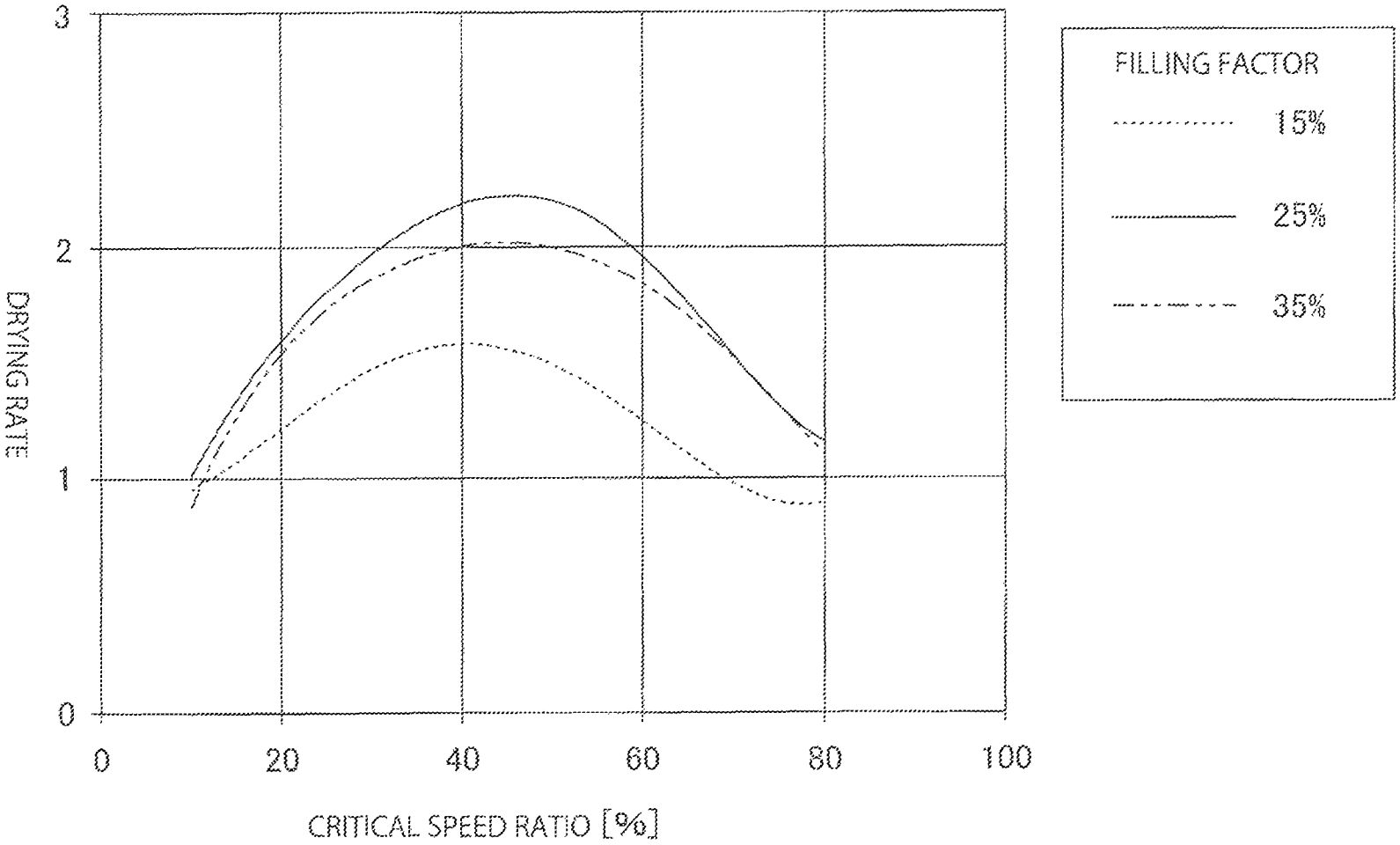
FIG. 16 is a graph illustrating a relationship between the critical speed ratio and the drying rate when a hold up ratio is changed.

Next, a relationship between the critical speed ratio $\alpha$ (%) of the rotating shell and the drying rate Rd of the terephthalic acid in the case of changing a hold up ratio of the terephthalic acid in the rotating shell 10, was examined. Concretely, the experiment was conducted by charging the terephthalic acid into the horizontal rotary dryer with an inside diameter of 370 mm, at 13 kg/h. The gap K between the heating tubes 11 arranged in the rotating shell 10 is 60 mm. Further, the median diameter of the terephthalic acid is 120 mm FIG. 16 is a graph illustrating the critical speed ratio and the drying rate when the hold up ratio is changed. Values of the drying rate in FIG. 16 are relative numeric values. In detail, a value of the drying rate when the hold up ratio is 25% and the critical speed ratio is 10% is defined as 1, and the values of the drying rate are represented by relative numeric values based on the value of 1. When operation was performed by setting the hold up ratio of the terephthalic acid to 15%, the contact area between the terephthalic acid and the heating tubes 11 was small, so that the drying rate was increased up to about 1.5 at the maximum. On the other hand, when operation was performed by setting the hold up ratio of the terephthalic acid to 25%, the contact area between the terephthalic acid and the heating tubes 11 was increased, and the drying rate was increased up to about 2.3 at the maximum. Further, when operation was performed by setting the hold up ratio of the terephthalic acid to 35%, slip occurred at an upper layer of powder layer (layer of terephthalic acid in powder form), and the number of terephthalic acid which was not brought into contact with the heat transfer surface increased. As a result of this, when compared to the case where the operation was performed with the hold up ratio of 25%, the drying rate was not increased, and the maximum value of the drying rate was about 2. However, the drying rate was faster than that when the operation was performed with the hold up ratio of 15%. Note that even if any one of the hold up ratios was employed, as the critical speed ratio was gradually increased from 10%, the drying rate increased, and the drying rate became the fastest in the range of 40% to 50% of the critical speed ratio. Further, when the critical speed ratio was further increased, the drying rate was lowered.

Through the above-described experiment, it was confirmed that it is preferable to employ the hold up ratio of 20 to 40% by which the drying rate of the processing material W significantly increases. When the hold up ratio 11 is 20 to 40%, the processing amount per unit cross-sectional area becomes large, and further, the drying rate also becomes fast. Further, since the upper limit of the hold up ratio η is not excessively large, good drying rate is provided. The hold up ratio is more preferably set to 25 to 30%.

Note that the above-described hold up ratio can be determined through the following expression 3, $$\eta = Ap/Af \cdot 100 \qquad \text{Expression 3}$$

wherein η indicates the hold up ratio (%), Ap indicates a cross-sectional area ($m^2$) occupied by the terephthalic acid with respect to a free cross-sectional area, and Af indicates a free cross-sectional area ($m^2$) as a result of subtracting a cross-sectional area of all of the heating tubes 11 from the entire cross-sectional area of the rotating shell 10. Note that the entire cross-sectional area Af of the rotating shell 10 indicates a cross-sectional area of the inside of the rotating shell 10 at an arbitrary transverse section of the rotating shell 10, and does not include an area of a thick wall portion of the rotating shell 10. Specifically, the entire cross-sectional area Af indicates a cross-sectional area calculated based on the inside diameter of the rotating shell 10.

(Experiment 5: Gap Between Heating Tubes 11)

Figure 17:
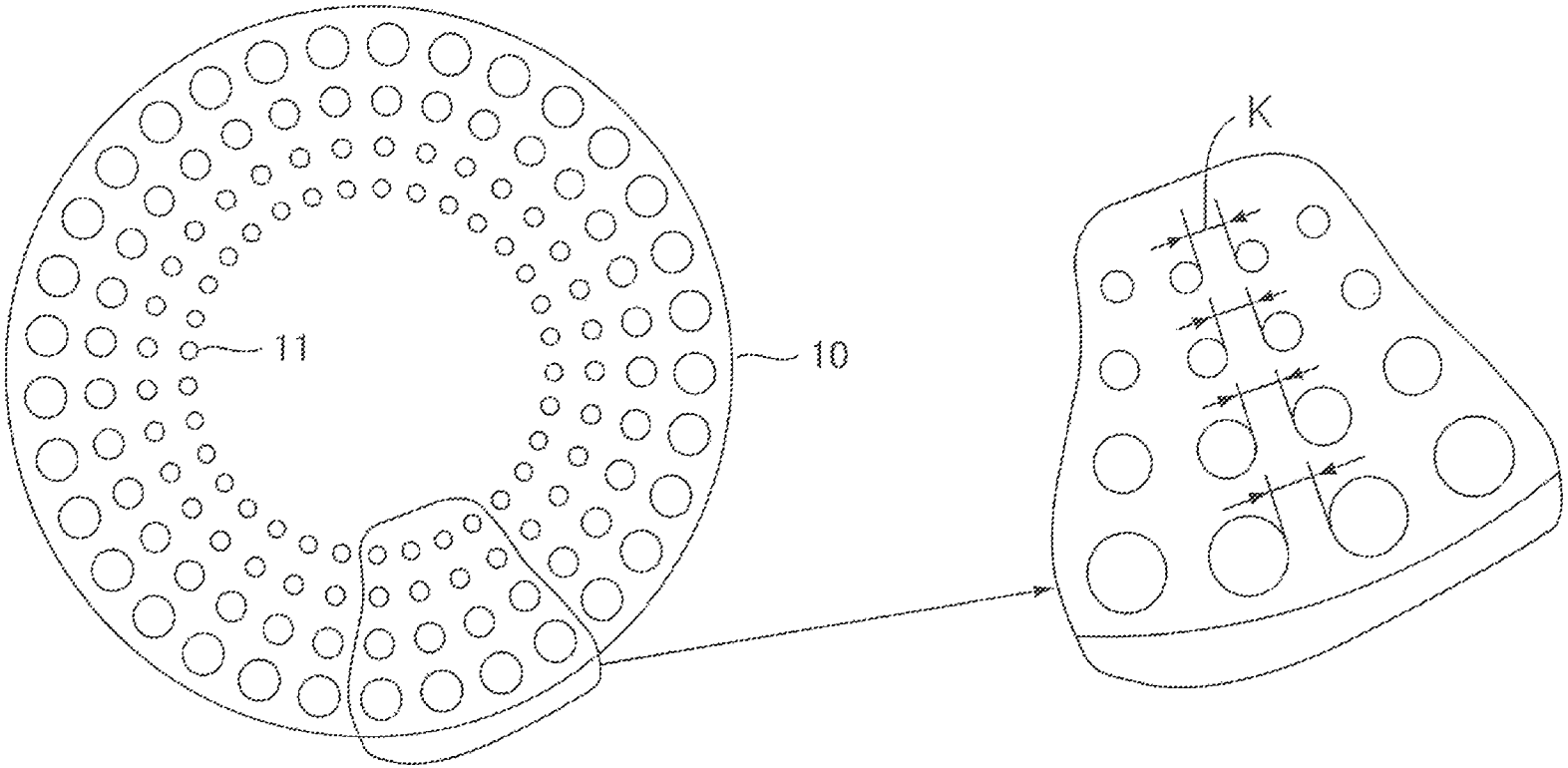
FIG. 17 is an explanatory diagram of a gap between heating tubes of the horizontal rotary dryer according to the present invention.

FIG. 17 illustrates the gap K between the heating tubes 11. In this example, the gap K is the same among four lines of concentric circles. For this reason, the diameter of the heating tube 11 is increased toward the outside. A distance between the adjacent heating tubes 11 (gap) K is preferably set to 60 to 150 mm. It is of course possible to perform appropriate modification such that the heating tubes 11 are set to have the same diameter, or the gap K is increased toward the outside, for example. Further, it is also possible to employ a later-described first arrangement form or second arrangement form.

Figure 18:
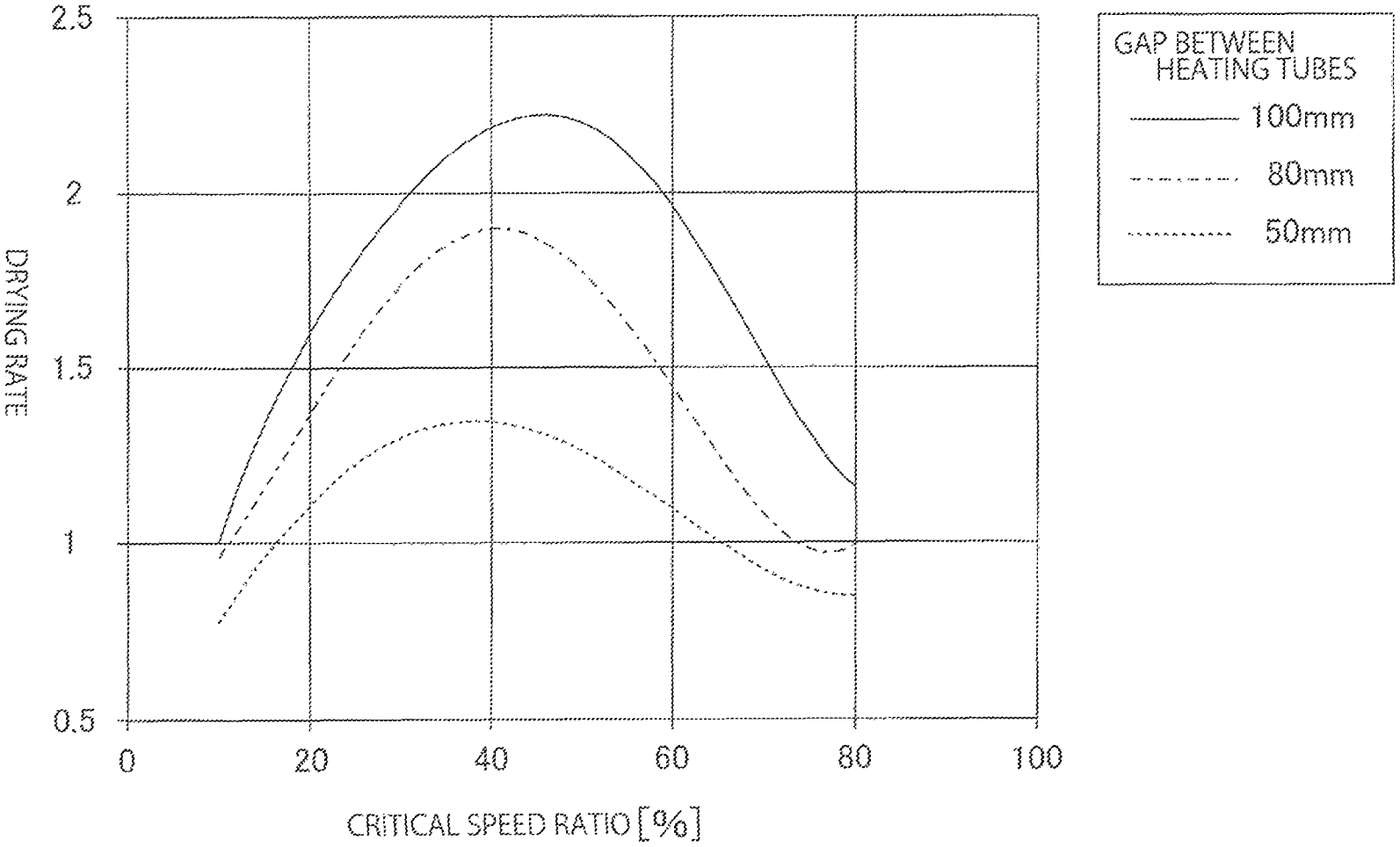
FIG. 18 is a graph illustrating a relationship between the critical speed ratio and the drying rate when a length of the gap between the heating tubes is changed.

Next, a relationship between the critical speed ratio α (%) of the rotating shell and the drying rate Rd of the terephthalic acid when the gap between the heating tubes 11 was changed, was examined. FIG. 18 is a graph illustrating the critical speed ratio of the rotating shell and the drying rate of the terephthalic acid, being results of the experiment. Values of the drying rate in FIG. 18 are relative numeric values. In detail, a value of the drying rate when the gap K between the heating tubes 11 is 100 mm, and the critical speed ratio is 10%, is defined as 1, and the values of the drying rate are represented by relative numeric values based on the value of 1.

The inside diameter of the rotating shell 10 is 1830 mm. Further, the arrangement of the heating tubes 11 when creating the graph in FIG. 18 was similar to that of FIG. 17. Specifically, the heating tubes 11 were arranged in a radial manner from a center of the rotating shell 10 toward the outside, and the diameters of the heating tubes 11 were gradually increased from the inside toward the outside. Accordingly, all of the gaps K between the heating tubes 11 positioned on the first column to the n-th column are set to be the same. For example, when the gap K between the heating tubes 11 is 50 mm, each of all of the gaps K between the heating tubes 11 positioned on the first column to the n-th column is 50 mm Note that this arrangement of the heating tubes 11 is similarly employed also in later-described FIG. 20.

When operation was performed by setting the gap K between the heating tubes 11 to 50 mm, an amount of the terephthalic acid flowing through the gap K was small, and the terephthalic acid was not mixed very much, resulting in that the drying rate was slow. Thereafter, as the gap K between the heating tubes 11 was increased to 80 mm and to 100 mm, the drying rate became gradually fast. It can be estimated that a part of the reason thereof is that the amount of the terephthalic acid flowing through the gap K becomes gradually large, and thus the mixing of the terephthalic acid favorably occurs. Note that at any hold up ratio, as the critical speed ratio was gradually increased from 10%, the drying rate increased, and the drying rate became the fastest in the range of 40% to 50% of the critical speed ratio. Further, when the critical speed ratio was further increased, the drying rate was lowered.

Through the above-described experiment, it was confirmed that the distance (gap) between the adjacent heating tubes 11 is preferably set to 60 to 150 mm, more preferably set to 80 to 150 mm, and still more preferably set to 80 to 100 mm (Relationship Between Outside Diameter and Inside Diameter)

In the above-described respective descriptions and respective expressions, the inside diameter D of the rotating shell 10 is used, and the outside diameter is not used. However, it is also possible to use the outside diameter by correcting the above-described respective expressions. This point will be described hereinafter in detail.

In the above-described respective expressions, D indicates the inside diameter, and a correcting expression for using, not the inside diameter, but the outside diameter, will be described. When the outside diameter of the rotating shell 10 is set to Do, the plate thickness (wall thickness) of the rotating shell 10 is set to t, and the inside diameter is set to D, a relationship among these is represented by the following expression 10.

$$D = Do - (2 \times t) \qquad \text{Expression 10}$$

Therefore, it is only required to substitute the right side in the expression 10 into D in the above-described respective expressions. For example, the expression regarding the critical speed ratio can be described as follows.

$$Vc = 2.21 D^{1/2}$$

$$Vc = 2.21 \times (Do - 2 \times t)^{1/2} \qquad \text{Expression 1}$$

Note that as a reference, a general numeric value of the wall thickness t of the rotating shell 10 of the STD or the like will be described. As the size of the rotating shell 10 becomes large, the wall thickness t tends to increase in order to maintain strength of the rotating shell, and actually, the wall thickness t is designed to have approximately the following numeric value. When the inside diameter D of the rotating shell 10 is 0.3 to 6 m, the wall thickness t becomes 3 to 100 mm Note that the inside diameter D of the horizontal rotary dryer according to the present invention is preferably set to 1 in to 5 m. Generally, even if the same critical speed ratio α of the rotating shell is employed, the smaller the inside diameter D of the rotating shell 10, the larger the number of rotations of the rotating shell 10. Therefore, when the inside diameter D is smaller than 1 m, the number of rotations of the rotating shell 10 significantly increases and large electric power is required, so that there is a problem that economic efficiency is poor. Further, when the inside diameter D is larger than 5 m, there is a problem that the size of the dryer is increased, which requires a large manufacturing cost.

<Regarding Heating Tube 11>

Although the size and the arrangement of the heating tubes 11 can be appropriately selected in the present invention, in order to increase mainly the contact efficiency to thereby increase the drying rate in the process of realizing the high-speed rotation aimed by the present inventors, it was found out that measurements to be described next are effective.

(Arrangement of Heating Tubes 11)

Figure 26:
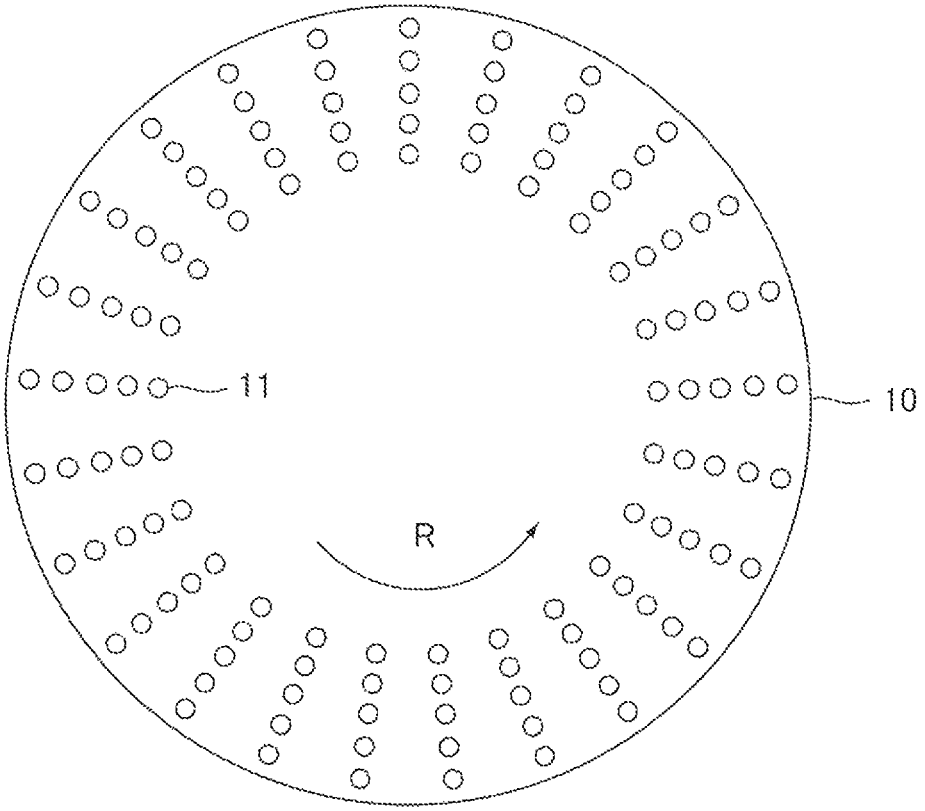
FIG. 26 is a transverse sectional view illustrating an example of arrangement of heating tubes of a conventional horizontal rotary dryer.

Conventionally, the heating tubes 11 have been arranged in a radial manner in the rotating shell 10, as illustrated in FIG. 26. In the rotating shell 10, the terephthalic acid (granular material) enters gaps between the plurality of heating tubes 11 moved to a lower part of the rotating shell 10, and lifted up in the rotational direction by the plurality of heating tubes 11 in accordance with the rotation of the rotating shell 10. The terephthalic acid lifted up to its repose angle starts to fall mainly at a point of time of exceeding the repose angle, and is subjected to falling motion. In more detail, the terephthalic acid falls, like a snowslide, from portions between the plurality of heating tubes 11 at upper positions exceeding the limit of the repose angle, and collides with the heating tubes 11 positioned at the lower part of the rotating shell 10.

The fallen terephthalic acid enters again the gaps between the plurality of heating tubes 11, 11 at the lower part of the rotating shell 10. It was clarified that, since an angle at which the terephthalic acid falls and an angle at which the terephthalic acid enters the gap between the heating tubes 11, 11 are different, the terephthalic acid does not immediately pass through the gap between the heating tubes 11, 11, and remains on the outside of the heating tubes 11, 11 (center side of the rotating shell 10), resulting in that the contact efficiency between the terephthalic acid and the heating tube 11 is poor. If the contact efficiency is poor, there arises a problem that the drying rate of the terephthalic acid is lowered.

Further, since the direction in which the terephthalic acid falls and the direction in which the terephthalic acid enters between the plurality of heating tubes 11, 11 are different, there was a problem that the fallen terephthalic acid collides with the heating tubes 11, 11 on the innermost column (column on the side closest to the center of the rotating shell 10), and kinetic energy once becomes zero (kinetic energy is reset).

The present invention improved the arrangement of the heating tubes 11 in order to solve the above-described problems.

Specifically, in the horizontal rotary dryer provided with: the rotating shell 10 having the feed port for terephthalic acid on one end side thereof and the discharge port for terephthalic acid on the other end side thereof, and capable of freely rotating around the axial center; and the large number of heating tubes 11, 11 . . . through which the heating medium passes, provided within the rotating shell 10, and heating and drying the terephthalic acid by using the heating tubes 11, 11 . . . in the process of feeding the terephthalic acid to the one end side of the rotating shell 10 and discharging the terephthalic acid from the other end side of the rotating shell 10, the arrangement of the heating tubes 11, 11 . . . desirably employs the following arrangement forms.

The group of the heating tubes 11, 11 . . . is arranged substantially in a concentric form around the center of the rotating shell 10, and a connecting line connecting from a core of a first reference heating tube S1 on the center-side circle to a core of a second reference heating tube S2, is selected from one of the following (1) and (2) arrangement forms, and an arrangement form as a result of combining these (1) and (2) arrangement forms.

Figure 21:
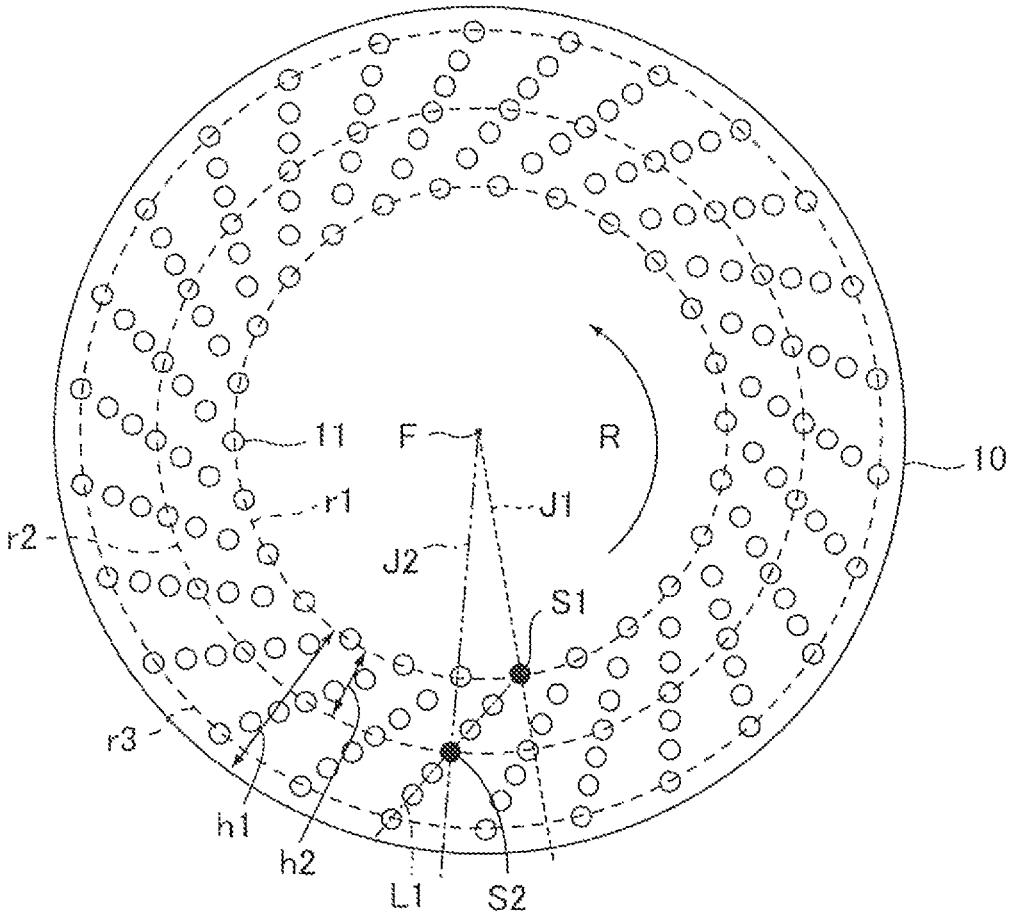
FIG. 21 is a transverse sectional view illustrating an example of arrangement of the heating tubes of the horizontal rotary dryer according to the present invention.

<With Reference to FIG. 21: Form In Shape of Diagonal Straight Line>

(1) First arrangement form in which cores of the respective heating tubes 11, 11 . . . are positioned on a straight line L1 directly connecting the core of the first reference heating tube S1 and the core of the second reference heating tube S2, and further, the core of the second reference heating tube S2 is positioned rearward in the rotational direction of the rotating shell 10 with respect to a radial line J1 passing through the core of the first reference heating tube S1.

Figure 19:
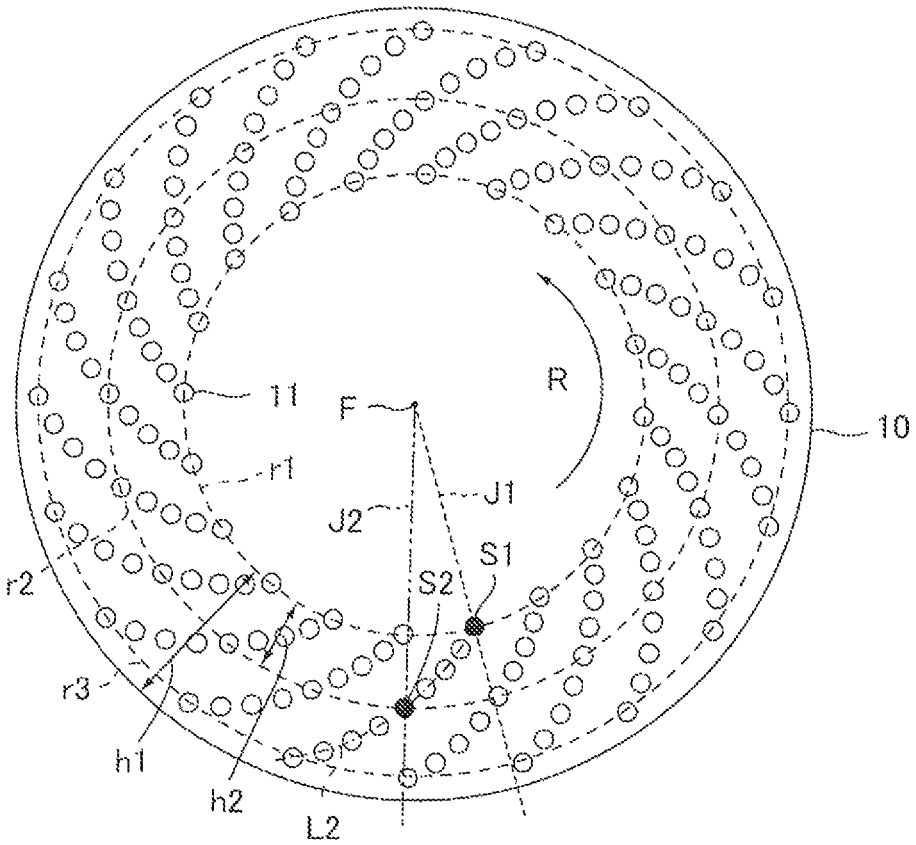
FIG. 19 is a transverse sectional view illustrating an example of arrangement of the heating tubes of the horizontal rotary dryer according to the present invention.

<With Reference to FIG. 19: Form In Shape of Curved Line>

(2) Second arrangement form in which cores of the respective heating tubes 11, 11 . . . are positioned on a curved line L2 connecting the core of the first reference heating tube S1 and the core of the second reference heating tube S2, and positioned further on the rear side in the rotational direction of the rotating shell 10 as they direct toward the core of the second reference heating tube S2, and further, the core of the second reference heating tube S2 is positioned rearward in the rotational direction of the rotating shell 10 with respect to a radial line J1 passing through the core of the first reference heating tube S1.

Specifically, as illustrated in FIG. 19 and FIG. 21, the heating tubes 11, 11 . . . are arranged in the concentric form around a center F of the rotating shell 10, and are arranged on respective concentric circles including a concentric circle r1 being a center-side circle on which the first reference heating tube S1 is positioned, a concentric circle r2 on which the second reference heating tube S2 is positioned, and a concentric circle r3 on which the outermost heating tubes 11 positioned on the outermost side of the rotating shell 10 is positioned.

Figure 20:
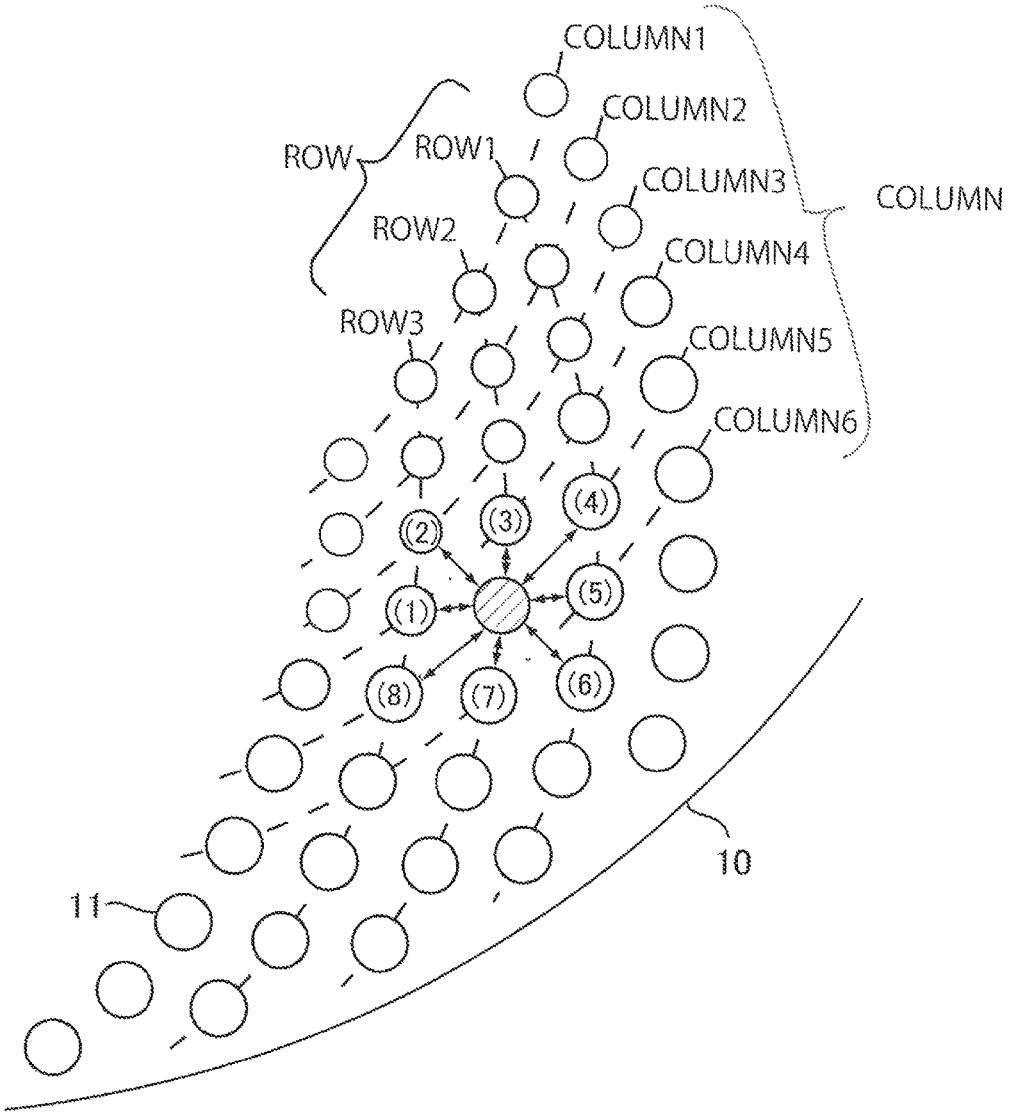
FIG. 20 is an explanatory diagram regarding a method of deciding arrangement of the heating tubes.

The core of the first reference heating tube S1 (refer to FIG. 19 and FIG. 21) corresponds to a core of the heating tube 11 (center of the heating tube) which is arbitrarily selected from a column of the group of the heating tubes 11 positioned on the side closest to the center of the rotating shell 10 ("column 1": refer to FIG. 20).

Further, the core of the second reference heating tube S2 indicates a core of the heating tube S2 (center of the heating tube) on a desired column number, in "columns" of the plurality of heating tubes (refer to FIG. 20), counted from the heating tube 11 positioned on the side closest to the center of the rotating shell 10 (the first reference heating tube S1) toward the outside along the same "row".

A position of the core of the second reference heating tube S2 can be appropriately selected in accordance with a flow behavior of the terephthalic acid (this flow behavior depends on a factor derived from physical properties (shape, size, viscosity, type of material, and the like) of the terephthalic acid, a factor derived from operating conditions of the dryer, and the like).

At this time, an arrangement ratio ε=h2 (from the concentric circle r2 on which the second reference heating tube S2 is positioned to the concentric circle r1 on which the first reference (innermost) heating tube S1 is positioned)/h1 (from an inner surface of the rotating shell 10 to the concentric circle r1 on which the first reference (innermost) heating tube S1 is positioned), is desirably set to greater than ½.

Further, in the present invention, at least a section from the first reference heating tube S1 to the second reference heating tube S2 desirably employs arrangement of heating tubes of the aforementioned first arrangement form or second arrangement form.

Further, the present invention also includes a case where the position of the core of the second reference heating tube S2 is on the concentric circle r3 on which the outermost heating tubes 11 are positioned.

As described above, the region which employs the first arrangement form or the second arrangement form can be appropriately selected, and in the example illustrated in FIG. 21, the total number of columns of the heating tubes 11 is seven, and the core of the second reference heating tube S2 is positioned on the fourth column.

FIG. 21 illustrates the example of the first arrangement form, and FIG. 19 and FIG. 20 illustrate the example of the second arrangement form.

FIG. 21 illustrates the example in which all of the seven columns employ the first arrangement form. Specifically, the cores of the respective heating tubes 11, 11 . . . are positioned on the straight line L1 directly connecting the core of the first reference heating tube S1 and the core of the second reference heating tube S2, and further, the core of the second reference heating tube S2 is positioned rearward in the rotational direction of the rotating shell 10 with respect to the radial line J1 passing through the core of the first reference heating tube S1.

FIG. 19 and FIG. 20 illustrate the example in which all of nine columns employ the second arrangement form. Specifically, the cores of the respective heating tubes 11, 11 . . . are positioned on the curved line L2 connecting the core of the first reference heating tube S1 and the core of the second reference heating tube S2, and positioned further on the rear side in the rotational direction of the rotating shell 10 as they direct toward the core of the second reference heating tube S2, and further, the core of the second reference heating tube S2 is positioned rearward in the rotational direction of the rotating shell 10 with respect to the radial line J1 passing through the core of the first reference heating tube S1.

Note that in FIG. 19 and FIG. 20, a line passing through the core of the first reference heating tube S1 and a line passing through the core of the second reference heating tube S2, by setting the center point F of the rotating shell 10 as a starting point, are indicated as the radial line J1 and a radial line J2, respectively. The respective distances of h1 and h2 described above may be determined from a distance on the radial line J2.

(Another Arrangement in Shape of Curved Line or Straight Line of Heating Tubes)

Other than the above, in another preferred embodiment of the present invention, it is also possible to employ an arrangement in which the gap between the adjacent heating tubes 11 is increased from the center side toward the outside on the concentric circles around the rotation axis of the rotating shell 10. FIG. 19 to FIG. 21 illustrate examples in which the gap between the adjacent heating tubes 11 is gradually increased from the center side toward the outside.

Further, as the curved line L2 connecting the core of the first reference heating tube S1 and the core of the second reference heating tube S2, it is possible to employ a cycloid (line drawn by a particle when the particle falls at the fastest speed), the Cornu's spiral (line drawn by a particle when the particle smoothly falls), a logarithmic curve, an arc line, a line approximated to these lines, or the like.

Figure 25:
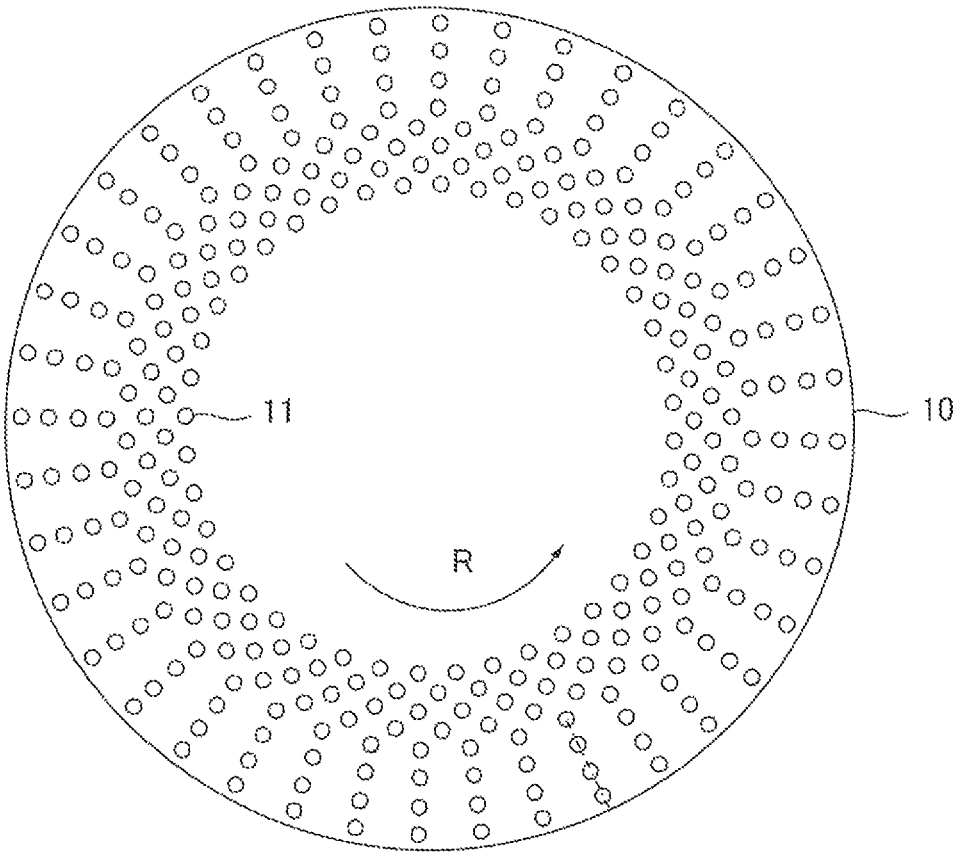
FIG. 25 is a transverse sectional view illustrating a state where the number of heating tubes is increased based on FIG. 22.

FIG. 25 illustrates an example of form in which inside parts of the heating tubes 11, 11 . . . are arranged in a shape of curved line in accordance with the second arrangement form, and outside parts of the heating tubes 11, 11 . . . are arranged along a radial direction.

Figure 22:
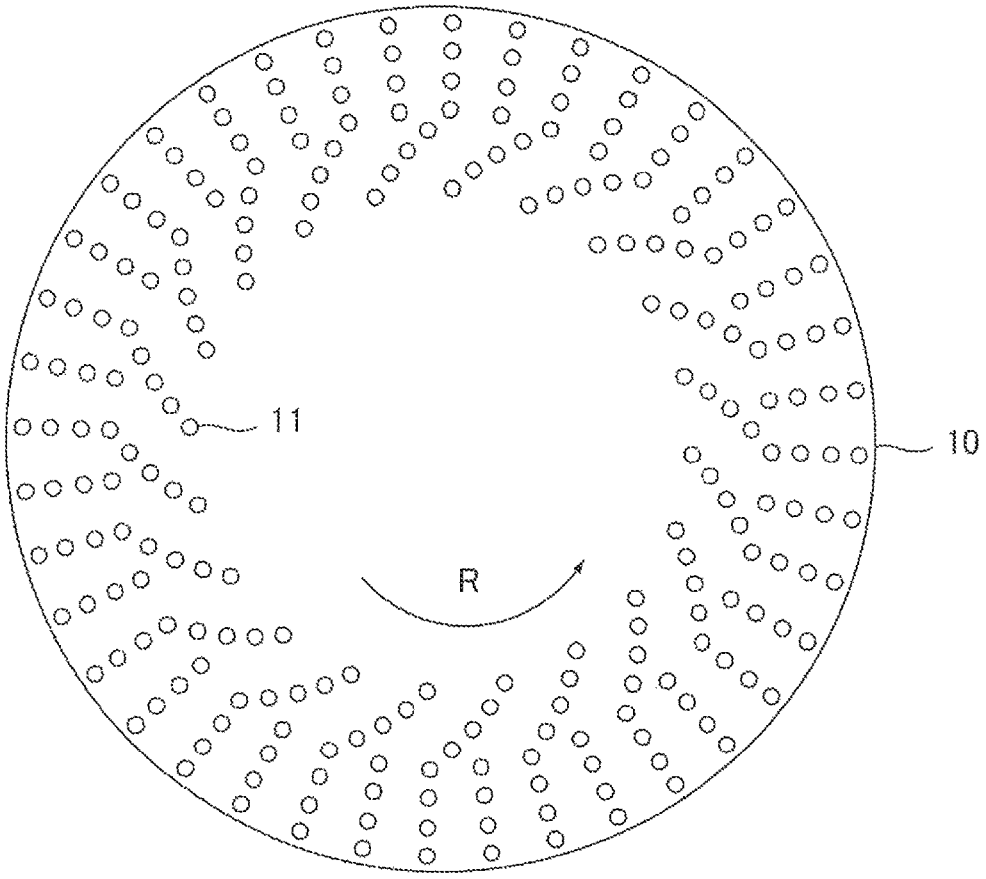
FIG. 22 is a transverse sectional view illustrating an example of arrangement of the heating tubes of the horizontal rotary dryer according to the present invention.
Figure 23:
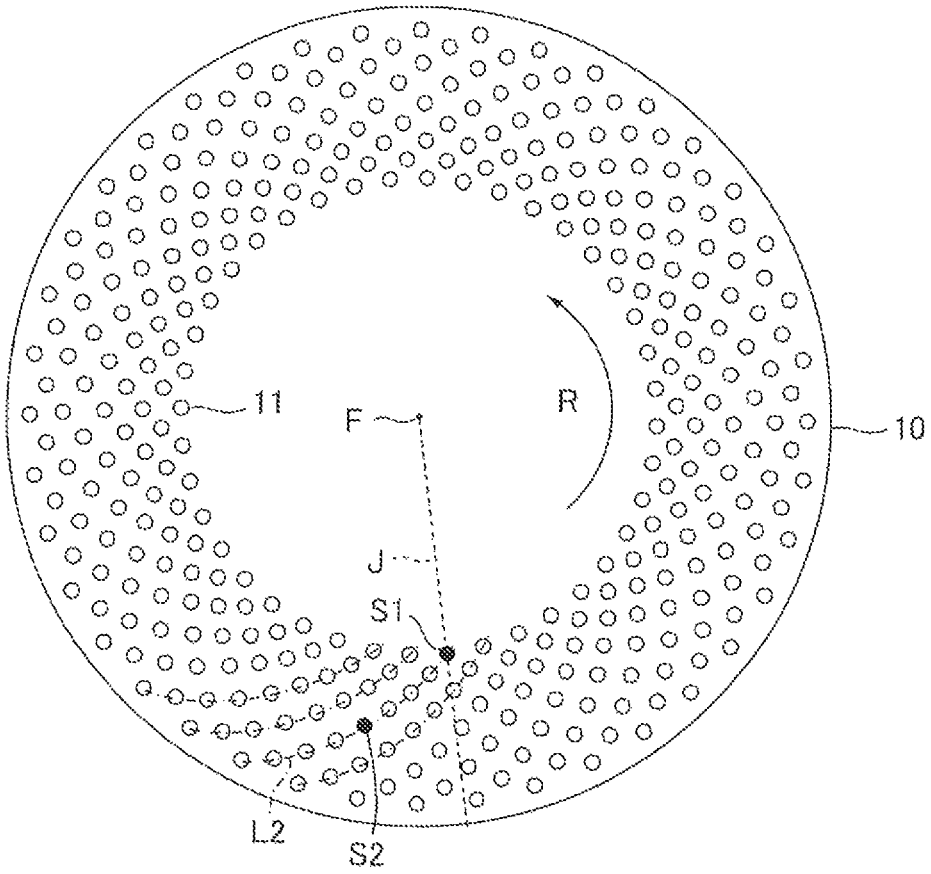
FIG. 23 is a transverse sectional view illustrating a state where the number of heating tubes is increased based on FIG. 19.

FIG. 22 illustrates an example of form in which inside parts of the heating tubes 11, 11 . . . are arranged in a shape of curved line in accordance with the second arrangement form, and outside parts of the heating tubes 11, 11 . . . are arranged along a radial direction.

Figure 24:
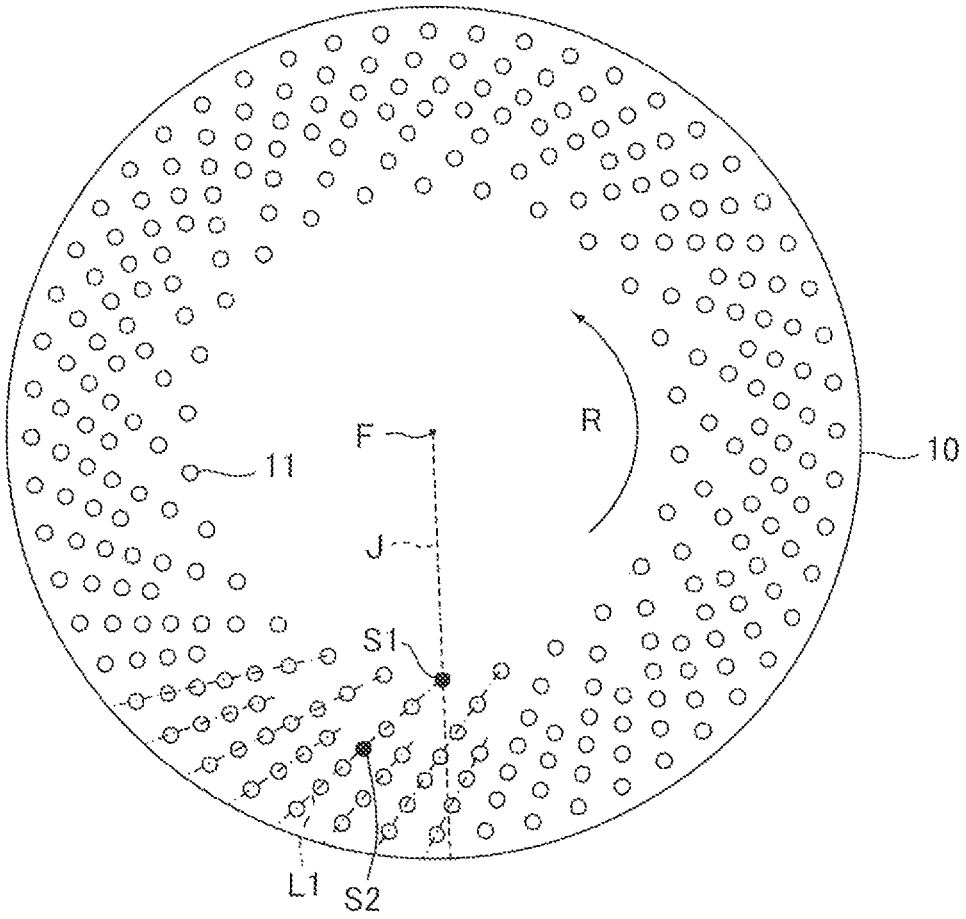
FIG. 24 is a transverse sectional view illustrating a state where the number of heating tubes is increased based on FIG. 21.

FIG. 24 illustrates an example in which the heating tubes 11, 11 . . . are arranged in a shape of diagonal straight line in accordance with the first arrangement form, in which regarding outside parts of the heating tubes 11, 11 . . . , rows of heating tubes arranged in a shape of diagonal straight line are interposed from positions on an intermediate concentric circle toward the outermost concentric circle.

On the other hand, as can be estimated based on these examples, it is also possible to arrange the heating tubes by combining the first arrangement form and the second arrangement form, although a concrete example thereof is not illustrated in the drawing.

Regarding all of the columns, when the first arrangement form and the second arrangement form are not employed, but, these arrangement forms are employed up to the middle of the columns, it is also desirable that the arrangement ratio ε=h2 (from the concentric circle r2 on which the second reference heating tube S2 is positioned to the concentric circle r1 on which the first reference (innermost) heating tube S1 is positioned)/h1 (from the inner surface of the rotating shell 10 to the concentric circle r1 on which the first reference (innermost) heating tube S1 is positioned), is set to greater than ½.

(Operation and Effect)

By arranging the heating tubes 11 in the shape of curved line or diagonal straight line as described above, the direction in which the terephthalic acid falls and the direction in which the terephthalic acid enters between the plurality of heating tubes 11 are approximated, resulting in that the fallen terephthalic acid enters the gap between the plurality of heating tubes 11, 11 without greatly changing its moving direction. The terephthalic acid which enters the gap between the heating tubes 11, 11 flows from the inside toward the outside of the rotating shell 10, and reaches a shell wall of the rotating shell 10. By selecting the arrangement of the heating tubes 11, the terephthalic acid immediately passes through the gap between the heating tubes 11 and does not remain on the outside of the heating tubes 11 (center side of the rotating shell 10), so that the contact between the terephthalic acid and the heating tubes 11 becomes good, which enables to improve the drying efficiency. Further, the contact area between the terephthalic acid and the heating tubes 11 increases, and the contact time between the both also increases, and also from that point, it is possible to improve the drying efficiency.

Further, since the terephthalic acid smoothly enters the gap between the heating tubes 11, 11, impact received by the heating tube 11 from the terephthalic acid becomes small. For this reason, when compared to a case where the heating tubes 11 are arranged in the conventional manner, the diameter of the heating tube 11 can be reduced, and the number of heating tubes 11 can be increased. As a result of this, the heat transfer area of the heating tubes 11 is increased as a whole, which enables to improve the drying efficiency.

Other than the above, in the conventional device, crush of the terephthalic acid (granular material) has occurred due to collision between the fallen terephthalic acid and the heating tube 11, but, according to the above-described preferred embodiments, it is possible to prevent or suppress the crush. As a result of this, the particle size distribution of the final product (dried product) is stabilized, and at the same time, fine powder is reduced, which enables to reduce the load on the exhaust gas processing facility.

Note that the diameter and the wall thickness of each of the heating tubes 11, 11 . . . can be appropriately selected.

(Number of Heating Tubes 11)

Although it is possible that all of the numbers of heating tubes 11 on the respective concentric circles are set to be the same, when the heating tubes 11 are provided in a shape of straight line, the number of heating tubes 11 from the outermost periphery to the vicinity of the middle of the rotating shell 10 is preferably set to be larger than the number of heating tubes 11 from the vicinity of the middle to the innermost periphery of the rotating shell 10, as illustrated in FIG. 24. By increasing the number of heating tubes 11 from the vicinity of the middle to the outermost periphery of the rotating shell 10 as described above, the distance between the adjacent heating tubes 11, 11 can be set to approximately the same from the innermost periphery to the outermost periphery. Further, by increasing the number of heating tubes 11, the heat transfer area of the heating tubes 11 increases, which enables to improve the drying efficiency of the terephthalic acid moved to the outer peripheral side of the rotating shell 10.

(Diameter of Heating Tube 11)

Although all of the heating tubes 11 may have the same diameter, it is also possible to design such that, as illustrated in FIG. 20, the diameter is gradually increased from the inner peripheral side toward the outer peripheral side of the rotating shell 10. By changing the diameters of the heating tubes 11 as described above, the distance between the adjacent heating tubes 11 can be set to approximately the same from the inner periphery to the outer periphery. By increasing the diameters of the heating tubes 11 as described above, the heat transfer area of the heating tubes 11 increases, which enables to improve the drying efficiency of the terephthalic acid moved to the outer peripheral side of the rotating shell 10.

(Method of Deciding Arrangement of Heating Tubes 11)

A method of deciding the arrangement of the heating tubes 11 will be described with reference to FIG. 20. Note that the arrangement of the heating tubes 11 is represented by "rows and columns", in which the arrangement in a radial direction of the rotating shell 10 (direction from the center side toward the outside of the rotating shell 10) is represented by the "column", and the arrangement in a circumferential direction of the rotating shell 10 is represented by the "row".

By changing a distance between adjacent rows (distance between row 1 and row 2, for example), and a distance between adjacent columns (distance between column 1 and column 2, for example), it is possible to change dispersibility and flowability of the terephthalic acid.

For example, when the heating tube 11 to which hatching is applied in FIG. 20 (referred to as "reference heating tube 11", hereinafter) is set as a reference, as a distance between rows, there can be considered, other than a distance between the heating tube 11 of (1) and the reference heating tube 11, and a distance between the heating tube 11 of (5) and the reference heating tube 11, a distance between the heating tube 11 of (2) and the reference heating tube 11, a distance between the heating tube 11 of (8) and the reference heating tube 11, a distance between the heating tube 11 of (4) and the reference heating tube 11, and a distance between the heating tube 11 of (6) and the reference heating tube 11, and each of these distances is set to have the above-described certain value or greater. Further, as a distance between columns, there can be considered a distance between the heating tube 11 of (3) and the reference heating tube 11, and a distance between the heating tube 11 of (7) and the reference heating tube 11, and each of these distances is also set to have the above-described certain value or greater. Note that the distance between the adjacent heating tubes 11 is preferably set to 80 to 150 mm As described above, the distance between rows and the distance between columns become restriction conditions at the time of deciding the arrangement of the heating tubes 11. Various variations are tested while changing the diameters of the heating tubes 11, the number of rows, and the number of columns so that the heat transfer area becomes as large as possible and the flowability is improved, while complying with the restriction conditions, and as a result of this, the arrangement with which the heat transfer area becomes the largest and the flowability is improved is adopted, and a product is designed. Note that as a result of actually studying the arrangement of the heating tubes 11, when a curvature of the row was gradually increased, by gradually decreasing the diameters of the heating tubes 11 and gradually increasing the number of columns, it was possible to realize the largest heat transfer area. On the contrary, when the curvature of the row was gradually decreased, by gradually increasing the diameters of the heating tubes 11 and gradually decreasing the number of columns, it was possible to realize the largest heat transfer area.

Note that although FIG. 19 to FIG. 25 illustrate the examples in which the plurality of columns of the heating tubes 11 are arranged, it is also possible to arrange only one column of the heating tubes 11, as exemplified in FIG. 13.

EXPLANATION OF NUMERALS AND SYMBOLS

10 rotating shell
11 steam tube (heating tube)
41 feed port
50 discharge port
55 classification hood
56 fixed exhaust gas opening
57 fixed discharge port
60 lifter
65 agitating unit
A carrier gas
E processed material
W processing material (terephthalic acid)

The invention claimed is:

1. A drying method for terephthalic acid using a horizontal rotary dryer provided with: a rotating shell having a feed port for terephthalic acid on one end side thereof and a discharge port for terephthalic acid on an other end side thereof, and capable of freely rotating around an axial center; and a group of heating tubes through which a heating medium passes, provided within the rotating shell, and configured in a manner that the terephthalic acid is lifted up in a rotational direction by the group of heating tubes in accordance with rotation of the rotating shell, the drying method for terephthalic acid comprising drying, through indirect heating, the terephthalic acid by using the group of heating tubes in a process of feeding the terephthalic acid to the one end side of the rotating shell and discharging the terephthalic acid from the other end side of the rotating shell, wherein the rotating shell is rotated to make a critical speed ratio α defined by following expression 1 and expression 2 become 17 to less than 80% to dry the terephthalic acid, $$Vc=2.21D^{1/2} \quad \text{Expression 1}$$

$$\alpha=V/Vc\cdot 100 \quad \text{Expression 2}$$

wherein Vc indicates a critical speed (m/s) of the rotating shell, D indicates an inside diameter (m) of the rotating shell, α indicates the critical speed ratio (%) of the rotating shell, and V indicates a rotation speed (m/s) of the rotating shell.

2. The drying method for terephthalic acid according to claim 1, wherein a liquid content of the terephthalic acid fed to the horizontal rotary dryer is 3 to 19 wt % W.B.

3. The drying method for terephthalic acid according to claim 1, wherein the terephthalic acid is fed into the rotating shell to make a hold up ratio η of the terephthalic acid defined by following expression 3 become 20 to 40%, $$\eta=Ap/Af\cdot 100 \quad \text{Expression 3}$$

wherein η indicates the hold up ratio (%), Ap indicates a cross-sectional area ($m^2$) occupied by the terephthalic acid with respect to a free cross-sectional area, and Af indicates a free cross-sectional area ($m^2$) as a result of subtracting a cross-sectional area of all of the heating tubes from the entire cross-sectional area of the rotating shell.

4. The drying method for terephthalic acid according to claim 1, wherein a plurality of the heating tubes are arranged in a radial manner or on concentric circles, and a separation distance between adjacent heating tubes is 60 to 150 mm.

5. A horizontal rotary dryer, comprising: a rotating shell having a feed port for terephthalic acid on one end side thereof and a discharge port for terephthalic acid on an other end side thereof, and capable of freely rotating around an axial center; and a group of heating tubes through which a heating medium passes, provided within the rotating shell, configured in a manner that the terephthalic acid is lifted up in a rotational direction by the group of heating tubes in accordance with rotation of the rotating shell, and drying, through indirect heating, the terephthalic acid by using the group of heating tubes in a process of feeding the terephthalic acid to the one end side of the rotating shell and discharging the terephthalic acid from the other end side of the rotating shell, wherein the rotating shell is configured to be able to rotate to make a critical speed ratio α defined by following expression 1 and expression 2 become 17 to less than 80%, $$Vc=2.21D^{1/2} \quad \text{Expression 1}$$

$$\alpha=V/Vc\cdot 100 \quad \text{Expression 2}$$

wherein Vc indicates a critical speed (m/s) of the rotating shell, D indicates an inside diameter (m) of the rotating shell, α indicates the critical speed ratio (%) of the rotating shell, and V indicates a rotation speed (m/s) of the rotating shell.

6. The horizontal rotary dryer according to claim 5, wherein the horizontal rotary dryer is provided in a manner that a rotation axis of the rotating shell is inclined with respect to a horizontal plane, and the one end side of the rotating shell is positioned higher than the other end side of the rotating shell, wherein an inclination angle between the rotation axis and the horizontal plane is 0.057 to 2.86 degrees.

* * * * *